US007302820B2

(12) United States Patent
Le Viavant

(10) Patent No.: US 7,302,820 B2
(45) Date of Patent: Dec. 4, 2007

(54) METHOD FOR CHANGING THE CONFIGURATION OF A ROLLING MILL AND ADVANCED ROLLING MILL FOR CARRYING OUT SAID METHOD

(75) Inventor: Germain Le Viavant, Beauchamp (FR)

(73) Assignee: Siemens VAI Metals Technologies SAS, Saint Chamond (FR)

( * ) Notice: Subject to any disclaimer, the term of this patent is extended or adjusted under 35 U.S.C. 154(b) by 0 days.

(21) Appl. No.: 10/547,706

(22) PCT Filed: Mar. 5, 2004

(86) PCT No.: PCT/FR2004/000540

§ 371 (c)(1),
(2), (4) Date: Sep. 2, 2005

(87) PCT Pub. No.: WO2004/080621

PCT Pub. Date: Sep. 23, 2004

(65) Prior Publication Data

US 2006/0196243 A1 Sep. 7, 2006

(30) Foreign Application Priority Data

Mar. 5, 2003 (FR) ..... 03 02725

(51) Int. Cl.
*B21B 31/00* (2006.01)

(52) U.S. Cl. ..... 72/237; 72/238; 72/243.4

(58) Field of Classification Search ..... 72/237, 72/238, 239, 245; 29/401.1
See application file for complete search history.

(56) References Cited

U.S. PATENT DOCUMENTS

| | | | | |
|---|---|---|---|---|
| 4,763,505 | A * | 8/1988 | Klute et al. | 72/238 |
| 4,905,493 | A * | 3/1990 | Benedetti | 72/225 |
| 6,244,090 | B1 * | 6/2001 | Le Viavant | 72/241.8 |
| 7,086,264 | B2 * | 8/2006 | Seidel et al. | 72/249 |

FOREIGN PATENT DOCUMENTS

| | | |
|---|---|---|
| JP | 63-13603 | 1/1988 |
| JP | 1-154803 | 6/1989 |

* cited by examiner

*Primary Examiner*—Dmitry Suhol
(74) *Attorney, Agent, or Firm*—Arent Fox LLP

(57) ABSTRACT

The invention relates to a method for changing the configuration of a rolling mill including at least two working rolls and two back-up rolls, means for applying a clamping load and two sets of hydraulic cambering cylinders, at least of both working rolls.

According to the invention, at least two types of working rolls (C1, C2) are realized having, respectively a great diameter and a small diameter and the quarto configuration rolling mill is switched to a sexto configuration and conversely, the rolls with great diameter (C1, C'1) being used as working rolls in the quarto configuration and, in the sexto configuration, as intermediate rolls between each back-up roll and a roll with small diameter (C2, C'2) used as a working roll.

34 Claims, 8 Drawing Sheets

FIG.6
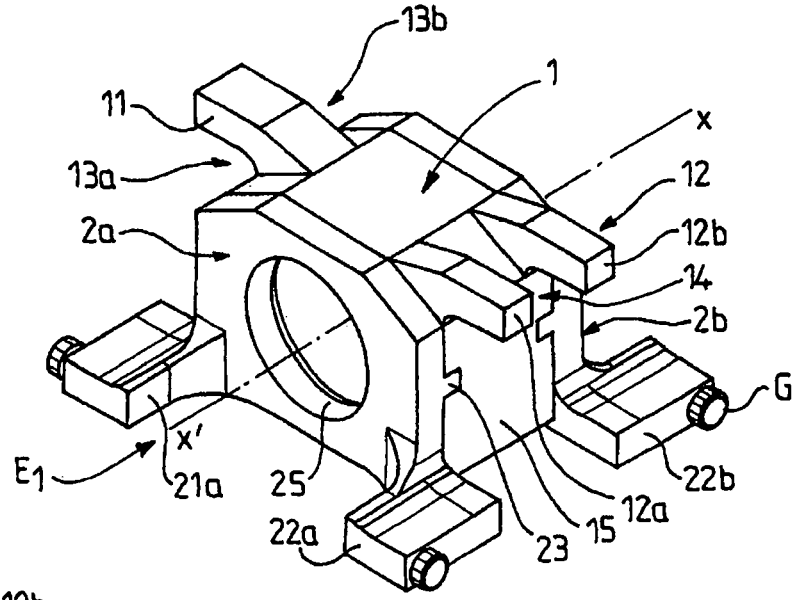
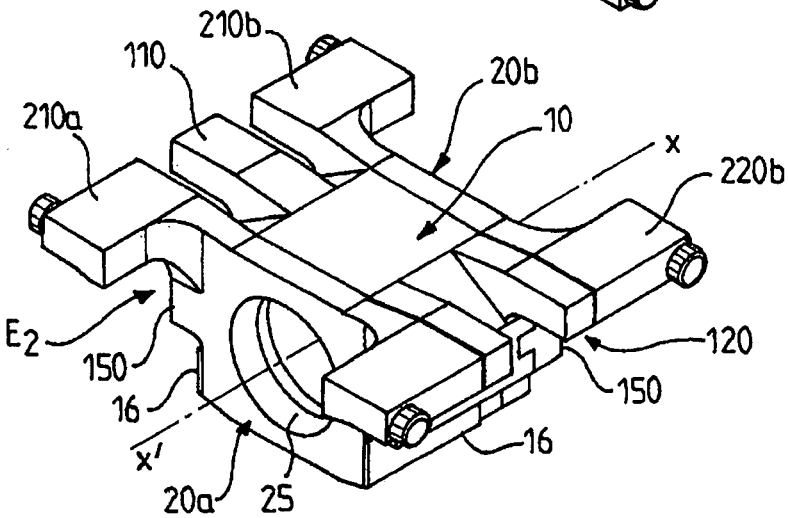
FIG.7
FIG.8
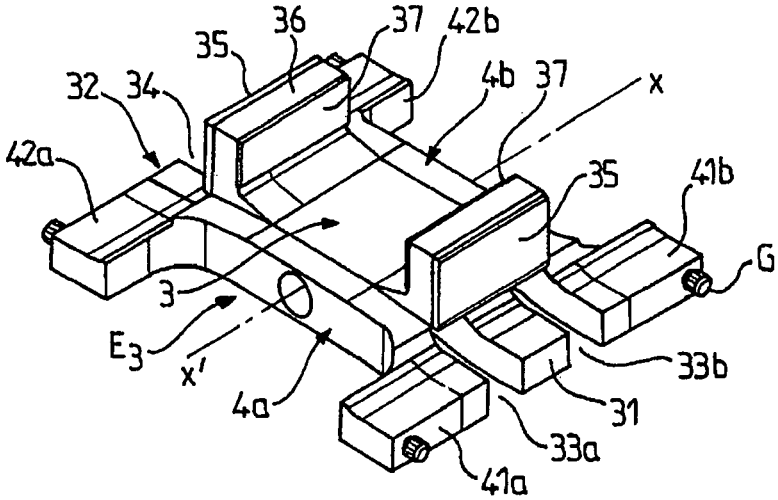

FIG.11
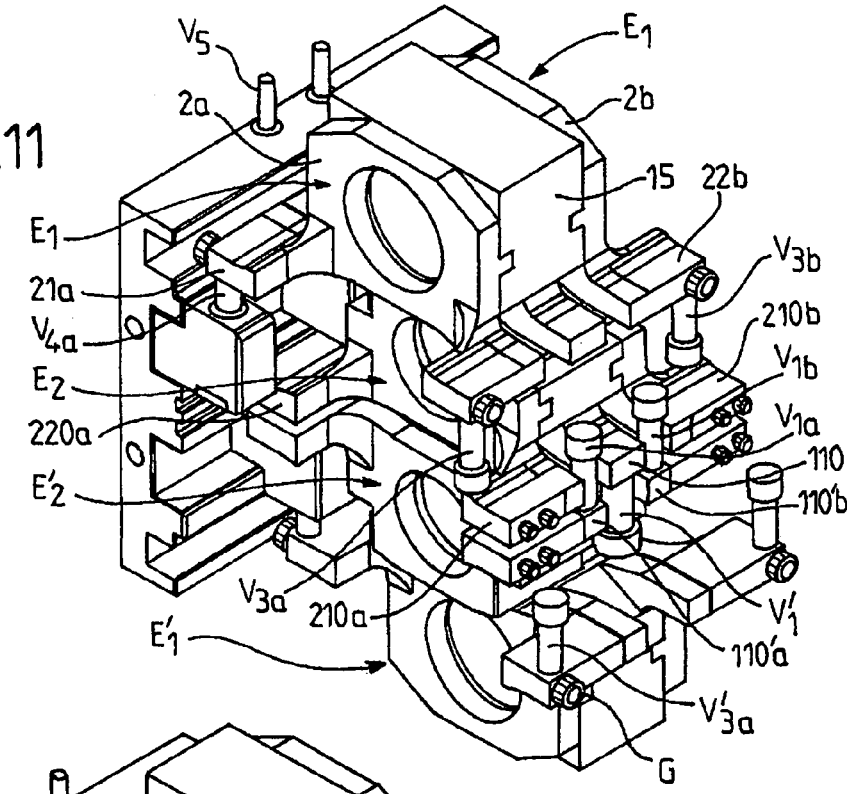
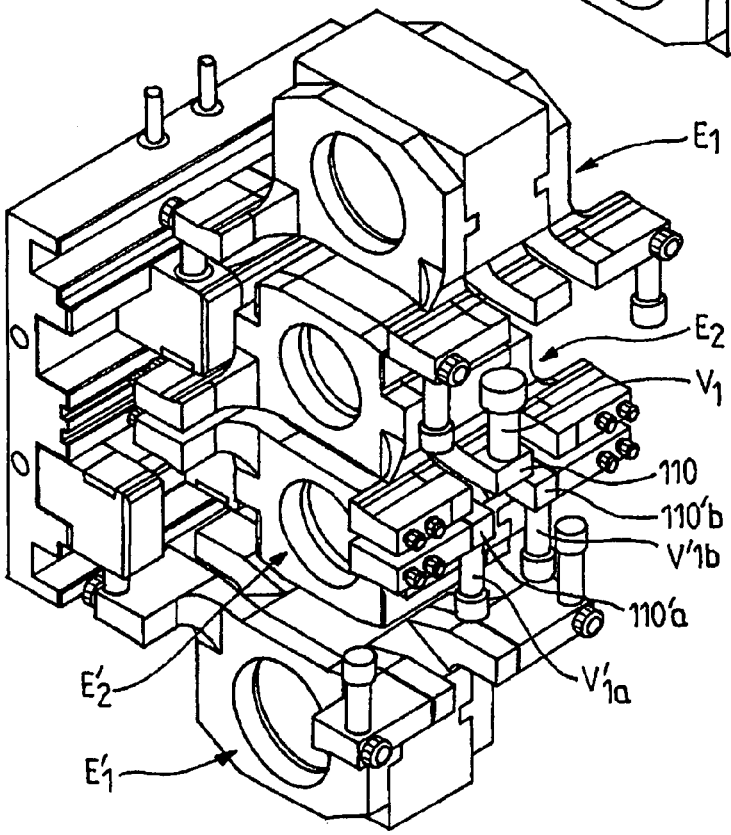
FIG.12

FIG.13
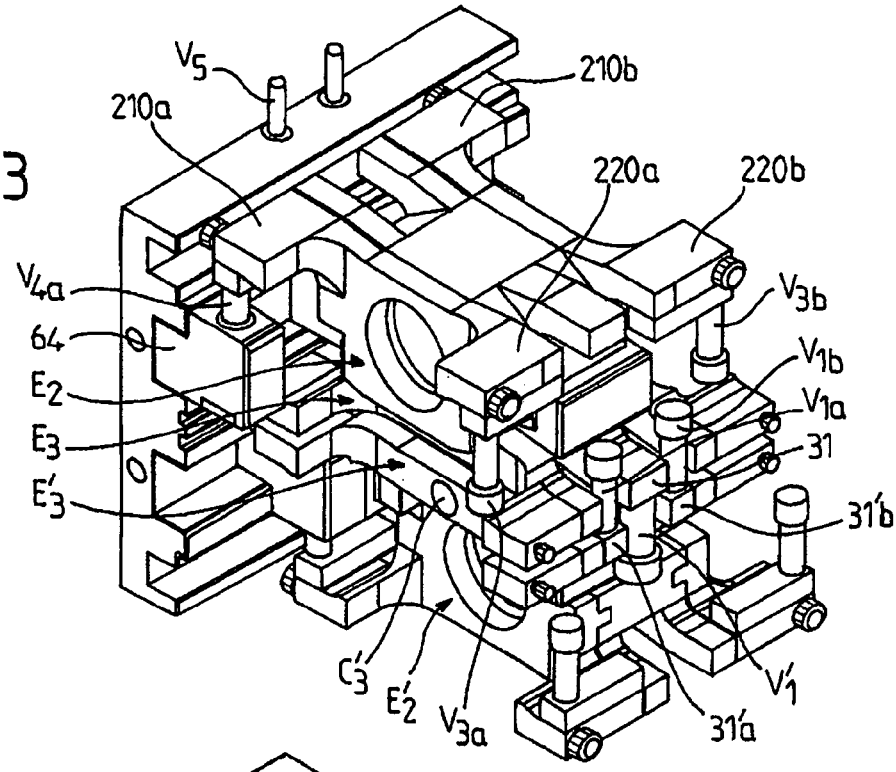
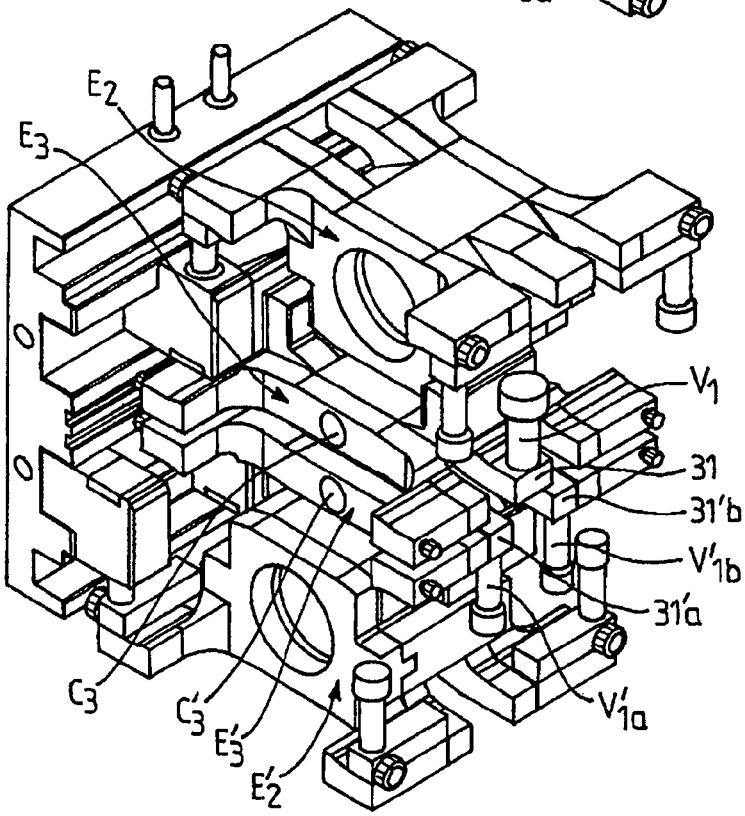
FIG.14

METHOD FOR CHANGING THE CONFIGURATION OF A ROLLING MILL AND ADVANCED ROLLING MILL FOR CARRYING OUT SAID METHOD

CROSS-REFERENCE TO RELATED APPLICATION

This application is a National Stage entry of International Application Number PCT/FR2004/000540, filed Mar. 5, 2004. The disclosure of the prior application is hereby incorporated herein in its entirety by reference.

The invention relates to a method for changing the configuration of a rolling mill and an advanced rolling mill for carrying out said method.

It is known that a rolling mill includes, generally, a holding stand having two spaced apart standards between which are arranged a set of superimposed cylinders with substantially parallel axes and containing, at least, two working rolls, respectively upper and lower which define a passage gap of the product to be rolled and rest, on the side opposite to the product, respectively on two back-up rolls. Each roll is set up rotary, at its ends, on bearings carried by supporting parts called chocks, which are set up slidingly in windows arranged in both columns of the stand, parallel to a clamping plane substantially vertical wherein the axes of the rolls are placed substantially. To this end, each chock is fitted, on both sides of the clamping plane, with sliding faces cooperating with corresponding guiding faces arranged on both sides of the corresponding window of the stand.

Since the working rolls have a diameter smaller than the back-up rolls, their chocks are narrower and their guiding faces should hence be closer. In the older rolling stands, these guiding faces are often arranged on jamb posts interconnected with the chocks of the back-up rolls and extending towards the rolling plane.

More recently, it has been suggested to lay out the guiding faces of the working chocks on the ends of guiding parts interconnected with the stand and protruding in each window, on both sides of the clamping plane.

So-called balancing, hydraulic cylinders, enable adjustment of the relative positions of the rolls for engaging the product or for disassembly of the rolls.

During the rolling process, the working rolls have a tendency to come apart from one another and the gap between the facing generatrices should be maintained by application of a clamping load between the chocks of the back-up rolls. The force of the rolling process to be exerted on the product to obtain a certain reduction rate in thickness depends, in particular, on the diameter of the working rolls which determines the length of the reduction zone wherein the metal flows as well as mechanical and metallurgical features thereof such as its elastic limit and its composition, for instance low-alloy low-carbon content current steel, stainless steel, steel alloy, etc.

The rolling stands used in the metal industry may exhibit several types of configuration according to the nature of the product to be processed.

Most current rolling mills, in particular for large productions, are of <<quarto>> type containing two working rolls associated, each, with a back-up roll with greater diameter, or of <<sexto>> type wherein intermediate rolls are interposed between each working roll and the corresponding back-up roll. The disposition enables, in particular, to offset axially, with respect to one another, both intermediate rolls in order to apply the rolling load, not over the whole table of the rolls, but only on the width of the product. Thus the deformations of the rolls are reduced and a product with greater flatness is obtained.

Besides, the use of intermediate rolls enables to use working rolls with small diameter and, thus, to reduce the rolling load necessary for a same reduction in thickness.

On the other hand, since the clamping loads are applied, normally, between both ends of both back-up rolls and that the rolled product, of variable width, does not cover generally the whole length of the working rolls, each roll may yield under the action of the loads applied. There results a variation in thickness of the passageway of the band between the working rolls which generate profile and flatness defects.

Moreover, the loads applied during the rolling process being extremely high, there must be a slight flattening of the external face of each roll, due to the so-called Hertz pressure.

There are hence, during the rolling process, flatness defects which may be measure downstream of the rolling mill, in order to correct them.

To this end, for some years, advanced systems have been developed, which enable to modulate the distribution of the stresses applied on the product during the rolling process.

In a system currently used, controlled flexion loads are applied on both ends of the shaft of each working roll in order to provide cambering effects enabling to correct the distribution of the stresses. To this end, the balancing cylinders may be used for adjusting the spacing of the working rolls.

These cylinders may be interposed between the chocks of the working rolls. Such a disposition, however, renders the power supply of the cylinders with hydraulic fluid more difficult and it is preferable, generally, to install the cylinders in the guiding parts of the chocks which, in the recent installations, are often arranged to protrude on fixed massive parts, on both sides of the window, on both stanchions of each standard of the stand. It is easier, indeed, to install the hydraulic systems on these parts which are called, consequently <<hydraulic blocks>>.

In such a case, the cylinders co-operate with resting members often called <<ears>> arranged on each lateral side of the chock, on both sides of the clamping plane.

Conventionally, so-called positive cambering is performed, by spacing apart the chocks of both working rolls to compensate for an excessive thickness of the central portion of the product but it is often interesting to have the possibility as well of realizing so-called negative cambering, by bringing chocks of both working rolls closer, to compensate for an excessive thickness of the edges of the product.

To realize a cambering in both directions, one may use single-effect cylinders acting each in a cambering direction but such a disposition makes the realization of the hydraulic blocks more complicated since, on both sides of the clamping plane, the chock should be associated with two cylinders acting each in one direction. Still, at the working rolls and close to the band, the space available is rather limited and makes the implantation of such a number of cylinders difficult.

To reduce the number of cylinders, one often uses hence double-effect cylinders whereof the rod is attached to the chock, in order to act in both directions.

In so-called <<sexto>> rolling mills, the cambering loads may also be applied to the intermediate rolls which are interposed between each working roll and the associated back-up roll and may, moreover, be moved axially, in opposite directions, in order to apply the rolling load, only to the width of the product, which enables to obtain a product with better flatness.

Since the flatness defects are easier to be corrected on a sexto rolling mill with small rolls, this type of rolling mill is often used for rolling relatively small thicknesses.

However, the thickness of the product to be rolled may vary over wide amplitude, in particular for rolling non-ferrous metals.

Still, the use of rolls with small diameter makes the engagement of the product between the rolls more difficult and may lead to failed engagement.

To solve this problem, the document JP-A-63 013 603 suggests using working rolls with relatively great diameter, in quarto assembly, for the great thicknesses and replacing each working roll with a set containing an intermediate roll and a working roll with small diameter, for passing thus in a sexto configuration better suited to small thicknesses.

To use the same cambering cylinders, the chocks of the working rolls in quarto and of the intermediate rolls in sexto are adapted so that their resting ears are placed substantially at the same level in each of the configurations.

Conversely, the cambering cylinders of the working rolls in sexto are not used in the quarto assembly.

Such a disposition enables hence easy adaptation to high variation in the thickness of the product to be rolled, for instance for rolling a copper or aluminium slab in a reversible stand.

Still, it has appeared, even in the case where the rolling mill is not intended for notable variation in the thickness of the product, it would be interesting to have the possibility of modifying quickly the configuration of the stand in order to suit, not a variation in thickness, but a modification of the features of the product to be rolled, for instance its hardness.

It has been discovered, indeed, that such a change in configuration would enable easy adaptation to the users' requirements which evolve constantly towards diversification of the qualities requested.

It is thus that, in the automotive industry, the trend is towards the use of steels having very accurate grades enabling to obtain high performances.

Moreover, it has been sought to reduce, as far as possible, the weight of the finished products, without reducing the resistance thereof and to obtain the same performances, thinner sheets have been required which call for high reduction rates, while maintaining the same requirements regarding regular thickness, flatness and surface quality.

For instance, as for car body work sheets, the grades called, commercially, CQ, DQ, DDQ, EDDQ have appeared in succession whereof the elastic limit extends from 180 Mpa to 250 Mpa as well as very hard steels having high elastic limit (HSLA) which may reach 600 Mpa. Conversely, very soft steels with very low carbon content are required whereof the elastic order is of the order of 160 MPa.

On the other hand, even the rolling process should be able to adapt to the quality of the steels processed, for instance to take into account since, in a tandem rolling mill, the rolling process determines, by temper rolling, gradual increase of the hardness of the product and, consequently, of the rolling load to be applied for a same reduction in thickness, from one stand to the next.

Consequently, the means for applying the clamping load may be saturated by said load if the initial hardness of the product is too high.

In the case, for instance, of a tandem rolling mill, one has the possibility of adapting the configuration of the successive stands to an increased hardness of the product by using first of all one or several quarto stands followed by sexto stands or so-called Z.High stands which enable, as known, to reduce further the diameter of the working rolls.

However, the stand itself should be adapted to the configuration, since the height of the window wherein the superimposed chocks should be threaded, depends on the number of rolls and the diameter thereof.

Moreover, the height of the hydraulic blocks also depends on the configuration since, in a sexto stand, resting and guiding parts should be provided for the intermediate rolls.

Besides, as indicated above, it is necessary to have different means to improve the flatness and the surface quality of the rolled product. For instance, in addition to the cambering devices described above, it is interesting to have the possibility of modulating the rolling load along the contact generatrix with the working roll or the intermediate roll, while transmitting the rolling load by means of a roll including a shroud set up rotatably around a fixed shaft and bearing thereon by dint of a series of cylinders enabling to vary the distribution of the stresses along of the bearing generatrix.

All these devices, as well as other enhancements, developed for several years, have enabled, in the cold rolling technique, in particular in tandem rolling mill, to improve continuously the quality of the finished product. However, these devices are costly and are hence profitable only as of a certain volume of production, the more so because said profitability should be maintained for several year to justify the level of investments.

To solve such a problem, the invention will enable to extend the production range of a rolling plant, while giving the possibility of adapting the configuration of the rolling mill to the structural and dimensional features of the product to be processed in order to switch, for instance, from a quarto configuration to a sexto configuration or, even, to a so-called <<Z.High>> configuration.

However, this change in configuration should take place very rapidly since the modern plants have a tendency to work in continuous line by butt-welding metal bands of different quality and the time for changing the configuration should remain compatible with the other operations to conduct in line.

Still, in the disposition of the document JP-A-63 013 603, it is necessary to use double-effect cylinders to ensure cambering in both directions, respectively positive and negative.

Consequently, the rods of the cylinders should be fixed removably on the chocks and these disassembly and reassembly operations of the cylinders extend the time necessary for changing the configuration. Such a shortcoming may be accepted simply to suit a change in thickness of the product. Conversely, if the configuration of the rolling mill is modified, according to the invention, in order to suit a new product to be rolled, it is necessary to reduce as far as possible the time for replacing the rolls.

So as not to dismantle the cambering cylinders, it is hence preferable to use exclusively single-effect cylinders which rest in a single direction on the chocks without being connected thereto. However, as indicated above, this doubles the number of cylinders and it is then difficult to find the necessary space at the level of the working rolls and close to the band whereof normally should be allowed to run further.

Still, the cambering cylinders should remain attached to the stand, as far as possible.

Besides, the rolls and in particular the working rolls are used in operation and should be removed periodically for cleaning and rectification of their surfaces. Their diameters vary hence over a certain range.

To enable immediate replacement, for each category, a set of rolls is available, having substantially the same diameter, within the wearing range.

These rolls are, however, very costly and their number should be limited, as much as possible.

Moreover, each roll is carried by two chocks which are also complex and costly members. Their disassembly is rather long and it is hence preferable, for a replacement, to remove the whole roll with its chocks in order to replace it with a new roll fitted with its chocks in advance. This requires, however, a very large number of chocks.

The invention intends to solve all these problems thanks to a method and a plant enabling to change easily and rapidly the configuration of a rolling mill for better adaptation to the nature of the product to be rolled. The invention enables, moreover, to use the same rolls with their chocks in several configurations and, thus, to limit the number of rolls and the number of chocks wherewith the plant should be equipped.

According to the invention, the rolling mill is fitted with at least two types of working rolls having at least two different diameters, respectively a great diameter and a small diameter and, while keeping the same stand, the same means for applying clamping and cambering loads and the same type of back-up rolls, the quarto configuration rolling mill is switched to sexto configuration and conversely, by changing only the disposition of the rolls interposed between the back-up rolls, the rolls with great diameter being used, in the quarto configuration as working rolls and, in the sexto configuration as intermediate rolls interposed respectively between each back-up roll remained in place and a roll with small diameter used as a working roll.

Particularly advantageously, the rolling mill is fitted with three types of working rolls having respectively a great, an average and a small diameter and the rolling mill is given one of at least three configurations, respectively at least one quarto configuration wherein the rolls with great diameter or with average diameter are used as working rolls, a sexto configuration wherein the rolls with average diameter are used as working rolls and the rolls with great diameter as intermediate rolls and a Z.High-type sexto configuration wherein the rolls with small diameter are used as working rolls and the rolls with average diameter as intermediate rolls between each working roll with small diameter and a back-up roll.

According to another preferred feature of the method, single-effect cylinders are used as positive or negative cambering cylinders which rest in a single direction on the chocks.

On the other hand, each roll remains fitted with its chocks, whereas said chocks may simply be turned over according to the position of the roll in the stand.

Thanks to the invention, all the means for applying and adjusting the distribution of the clamping loads are remained in place in the stand when changing configuration. However, as the rolls of a same type have, after rectification, diameters varying over a certain range, it may be advantageous, for a quarto configuration, to install in the stand back-up rolls whereof the diameter is greater than for a sexto configuration.

Moreover, it should be noted that, for maintenance and changing spare parts, the invention enables superimposing the wearing ranges of the working rolls and intermediate rolls and, thus, to have a great total wearing range of the rolls event if a new surface treatment is required. Similarly, for the back-up rolls, the invention enables to associate the wearing ranges in order to increase the total range.

The invention also covers an advanced rolling mill for carrying out said method, including, generally, a holding stand, a set of superimposed cylinders set up rotary, each, on two chocks, means for applying a clamping load and means for applying vertical cambering loads, at least on the chocks of the working rolls, respectively in a positive spacing-apart direction of said chocks relative to the rolling plane and in a negative bringing-closer direction and including, on both sides of the clamping plane, two sets of hydraulic cambering cylinders, respectively upper and lower, which co-operate with resting members arranged on the sides of each chock, on both sides of the clamping plane.

According to the invention, the rolling mill is fitted with at least two pairs of working rolls having at least two different diameters and usable as a working roll inside the same stand in at least two configurations of the rolling mill, respectively a quarto configuration wherein both rolls with great diameter are used as a working roll and a sexto configuration wherein both rolls with small diameter are used as a working roll and the rolls with great diameter as intermediate rolls arranged, respectively, between each working roll with small diameter and the back-up corresponding roll, while keeping, in both configurations, the same stand, the same type of back-up rolls and the same means of application of clamping loads and of cambering loads.

In a preferred embodiment, the rolling mill is fitted with at least three pairs of rolls having respectively a greater, an average and a small diameter and usable as working rolls inside the same stand in at least three configurations of the rolling mill, respectively at least one quarto configuration wherein the rolls with great diameter or with average diameter are used as working rolls, a sexto configuration wherein the rolls with average diameter are used as working rolls and the rolls with great diameter as intermediate rolls and a Z.High-type sexto configuration wherein the rolls with small diameter are used as working rolls associated with lateral resting means and the rolls with average diameter as intermediate rolls.

According to another particularly advantageous feature of the invention, for changing the configuration, the rolls remain fitted with their chocks and the resting members of the chocks, at least of the rolls with greater diameter, are offset vertically with respect to the rotational axis of the roll, so that, after vertical displacement of the roll with great diameter and 180°-rotation of its chocks around the axis, the resting members of said roll are placed substantially at the same level with respect to the rolling plane, respectively in the quarto configuration and in the sexto configuration, and that the same cambering cylinders act in the positive direction on the same chocks, respectively in working position in the quarto configuration and, after rotation, in intermediate position in the sexto configuration.

In a preferred embodiment, the resting members of the chocks of both working rolls which, conventionally, protrude relative to the corresponding sliding faces, are placed, in each configuration, substantially in the vicinity of the rolling plane and each resting member of a first working chock placed on a first side of the rolling plane is fitted with a recess for letting through the rod of a cambering cylinder placed on said first side and running through the rolling plane for resting, in the positive direction, on a corresponding resting member of the second working chock placed on the second side of the rolling plane and fitted with a recess for letting through the rod of a cambering cylinder placed on said second side and running through the rolling plane for resting, in the positive direction, on the resting member of the first working chock.

According to another preferred feature of the invention, the sets of cambering cylinders, respectively upper and lower, are centered substantially in two planes parallel to the clamping plane and spaced apart symmetrically on both sides thereof.

As indicated above, each column of the stand is fitted with two hydraulic blocks fixed, on both sides of the clamping plane, on the sides of the corresponding window and containing guiding parts wherein cambering cylinders are housed, respectively upper and lower, and which protrude, towards the inside of the stand, up to a guiding face parallel to the clamping plane and cooperating, in the configurations quarto and sexto, with a corresponding sliding face of a working chock.

According to another feature of the invention, in the sexto configuration, the sliding faces of the chocks with great diameter serving as intermediate chocks, co-operate with guiding faces arranged on supporting parts set up removable inside the corresponding window of the stand, respectively, above and below both protruding parts of the hydraulic block, whereas these supporting parts may be jamb posts attached, removably, on the chocks of both back-up rolls.

According to another preferred feature of the invention, each protruding part of a hydraulic block carries two groups of cylinders acting respectively towards the rolling plane and on the side opposite thereto, while resting on said protruding part, and the resting members of the chocks are placed substantially on three levels which remain the same in all the configurations, respectively a central resting level of the working chocks, corresponding substantially to the rolling plane, and two resting levels, respectively upper and lower, of the intermediate rolls, placed respectively above and below the protruding parts of the hydraulic blocks.

Preferably, each protruding part of a hydraulic block carries, in a central zone, at least one pair of opposite cylinders acting respectively in the bringing-closer and spacing-apart direction of the rolling plane and, on both sides of this central zone, two lateral cylinders acting in the spacing-apart direction of the rolling plane.

According to another particularly advantageous feature of the invention, each chock of a roll with great or average diameter, is formed of three abutting portions, respectively a central portion for supporting a centering bearing of the corresponding roll and two end portions, each supporting two resting members extending on both sides of the clamping plane, fixed to both lateral sides, perpendicular to the axis, of the central portion, removably enabling, on the one hand, to interconnect the central portion with both end portions for transmitting the clamping loads and, on the other hand, to rotate the end portions with respect to the central portion, after disconnection of the three portions.

Besides, the central portion of each chock is fitted, on both sides of the clamping plane, with a resting member for at least one central cambering cylinder placed on a first side of the rolling plane, said resting member containing at least one recess for letting through the rod of at least one central cambering cylinder placed on the other side of the rolling plane.

In such a case, each hydraulic cambering block placed on one side of the clamping plane, includes advantageously a central group of cylinders containing at least two pairs of opposite cylinders acting respectively on the resting members of the central portions of both working chocks placed on both sides of the rolling plane, each pair including two cylinders acting respectively in the positive direction and in the negative direction on a resting member of one of the chocks, and each positive cambering cylinder of a first chock placed on a first side of the rolling plane bears on the other side on the hydraulic block and goes through said rolling plane while running through a recess provided in the corresponding resting member of a second chock placed on the other side of said rolling plane.

In a preferred embodiment, the central portion of a first working chock placed on a first side of the rolling plane includes, on a first side of the clamping plane, a resting member containing a single resting portion cooperating with a pair of opposite cambering cylinders and sandwiched by two recesses, and, on the second side of the rolling plane, a resting member containing two resting portions spaced apart on both sides of a single recess and cooperating respectively with two pairs of opposite cylinders controlled synchronously, the disposition of the resting members and of the cylinders being reversed for the second working chock placed on the other side of the rolling plane.

Moreover, the dispositions according to the invention are applicable to a rolling mill containing means for axial displacement, with respect to one another, intermediate rolls in order to suit to the width of the product the length of the rolls whereon the rolling load is exerted.

To this end, in a preferred embodiment, each protruding part, respectively upper or lower of a hydraulic block includes a fixed central portion with respect to the stand and two lateral mobile portions placed on both sides of the central portion and set up slidingly axially on the hydraulic block, and each set of cambering cylinders, respectively upper or lower, includes at least one central cylinder bearing on the fixed central portion of the protruding part and acting towards the rolling plane, and at least two lateral cylinders bearing respectively on both lateral mobile portions of the protruding part and acting of the side opposite to the rolling plane, each chock including a central portion fitted, on each side, with a resting member for at least one cylinder central, and two end portions abutting on both sides of the central portion and fitted each, on both sides of the clamping plane, of a resting member for a lateral cylinder mounted on a corresponding mobile portion of the protruding part.

Other particularly advantageous features, within the scope of the invention, will appear during the following description of a particular embodiment, given for exemplification purposes and represented on the appended drawings.

FIG. 6 shows, in perspective, a type of chock adapted to a roll with a great diameter.

FIG. 7 shows, in perspective, a type of chock adapted to a roll with an average diameter.

FIG. 8 shows, in perspective, a type of chock usable for a roll with a small diameter, in a Z.High configuration.

FIG. 11 and FIG. 12 are partial perspective views of the cambering means of the rolls, respectively positive and negative, in a sexto configuration, with axial offset of the intermediate rolls.

FIG. 13 and FIG. 14 are partial perspective views of the cambering means of the rolls, respectively positive and negative, in a Z.High configuration, with axial offset of the intermediate rolls.

FIG. 1 is a cross sections of the three configurations (a), (b), (c) which may be conferred to a rolling mill according to the invention.

Figure 1:
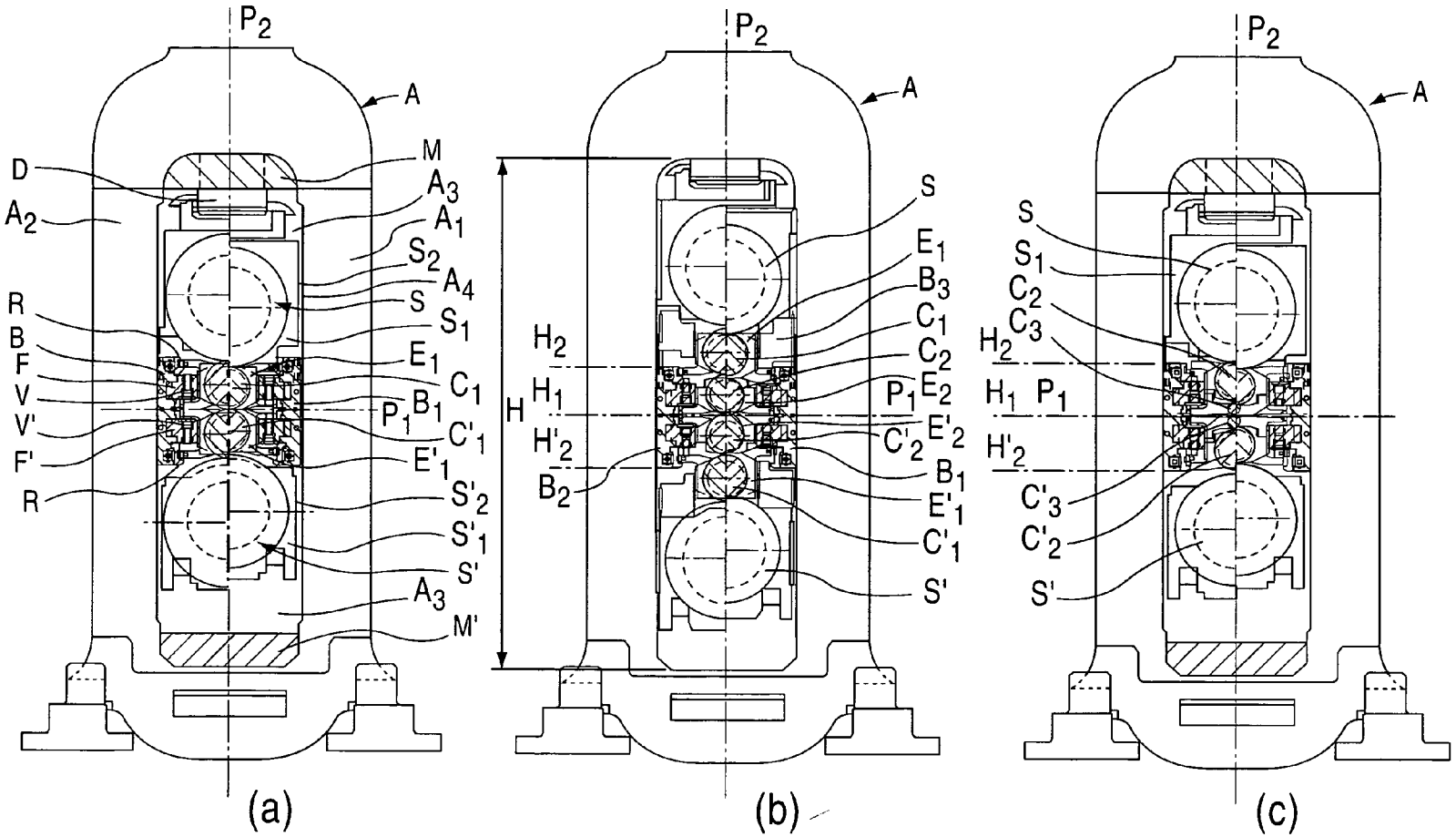
FIG. 1 shows, as a cross section, a rolling mill enabling, according to the invention, the assembly of the rolls in three configurations, respectively quarto (a), sexto (b) and Z.High (c).

This rolling mill includes, as usual, a supporting stand A containing two columns standards connected by a crossbeam and resting on a foundation block. Each column includes two stanchions A1, A2 delineating a window A3 wherein the chocks of the rolls are mounted.

In the quarto configuration represented on FIG. 1*a*, the rolling mill includes two working rolls C1, C'1 placed on both sides of a rolling plane P1 substantially horizontal and resting, in the opposite side, on two back-up rolls S, S' carried, at their ends, by bearings (not represented) which are housed in chocks S1, S'1 mounted slidingly in the windows A3 of each column, parallel to a clamping plane P2, generally vertical, wherein the axes of the rolls are placed substantially. The same goes, in the embodiment represented in the drawings, for the working rolls C1, C'1 which are also carried by chocks E1, E'1 sliding vertically.

Thus, it is possible, on the one hand, to adjust the spacing, or gap, between the working rolls C1, C'1 relative to the raw thickness of the product to be rolled, to enable the engagement thereof and, on the other hand, to exert a clamping load between the rolls for the rolling process of the product.

As usual, in the example represented in the drawings, clamping means D are used, such as screws or cylinders resting, on one side, on the stand, at the upper section of each window A3, and, on the other, on the chocks S1 of the upper back-up rolls S, whereas the chocks S'1 of the lower back-up rolls S rest on the lower section of each window A3, through wedging means not represented, whereof the height may vary in order to adjust the level of the rolling plane P1.

To enable height adjustments of the rolls, each chock S1, S'1 of a back-up roll S, S' is fitted with lateral sliding faces S2, S'2 which slide along mated guiding faces A4, parallel to the clamping plane P2, arranged on the internal faces of both stanchions A1, A2 of the column A.

The chocks E, E' of the working rolls C1, C'1 should also slide vertically but they are narrower due to the reduced diameter of the working rolls C1, C'1. Consequently, each window A3 of the stand is fitted, in the vicinity of the rolling plane P1, with resting and guiding parts B1, B2 called generally <<hydraulic blocks>> for the reasons stated above. Thus, each chock E is mounted slidingly along guiding faces arranged on the ends of portions F, F' of both hydraulic blocks which protrude, from both sides of the window A3, towards the inside thereof. On the other hand, these protruding portions F, F' carry, sets of cylinders V, V' exerting cambering loads on the chocks E, E' of both working rolls C1, C'1.

Generally, these dispositions are well known and do not require any detailed description.

It should be noted however, that as shown by each drawing in two semi-sectional views, on both sides of the vertical axis, the diameter of each type of rolls may vary on a certain range since, as indicated above, it is necessary to rectify periodically, by machining, the external face of the rolls whereof the surface quality may deteriorate in the long run. It is the case, in particular, for working rolls which are in contact with the rolled product. But the other rolls, intermediate or back-up rolls, should also be replaced after a certain time of use, with new, rectified rolls.

A rolling plant should hence be equipped with several rolls of each type having, in new condition, a set diameter which may then decrease over a certain wearing range, according to the successive rectifications. Each stand should hence be equipped with roll guiding and clamping means extending over an adjustment range which depends not only on the thickness variation of the product but also on the number of rolls and on their diameters.

As shown on the three views, a, b, c, of FIG. 1, the invention enables to give one of three configurations respectively quarto (a), sexto (b) or Z.High (c) to the same rolling mill, while keeping the same stand A, the same back-up rolls S, S', the same means D for applying the clamping load, the same hydraulic blocks B1, B2 and the same cambering means V, V'.

Figure 3:
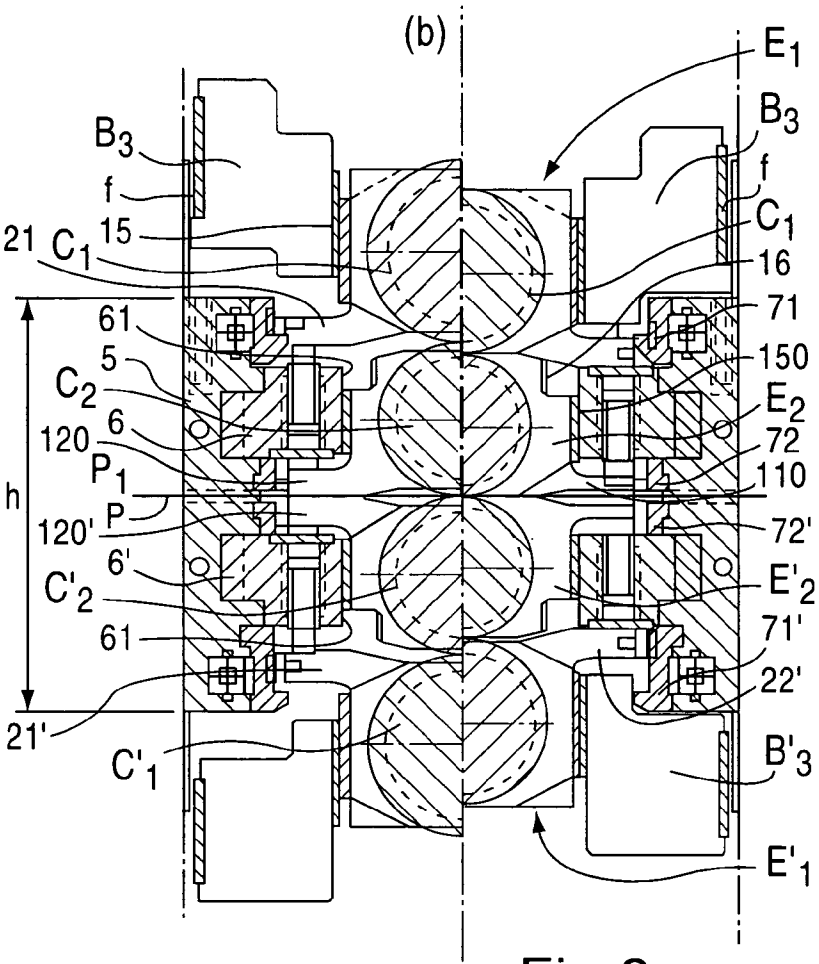
FIG. 3 shows the disposition of the rolls in a sexto configuration (b).
Figure 2:
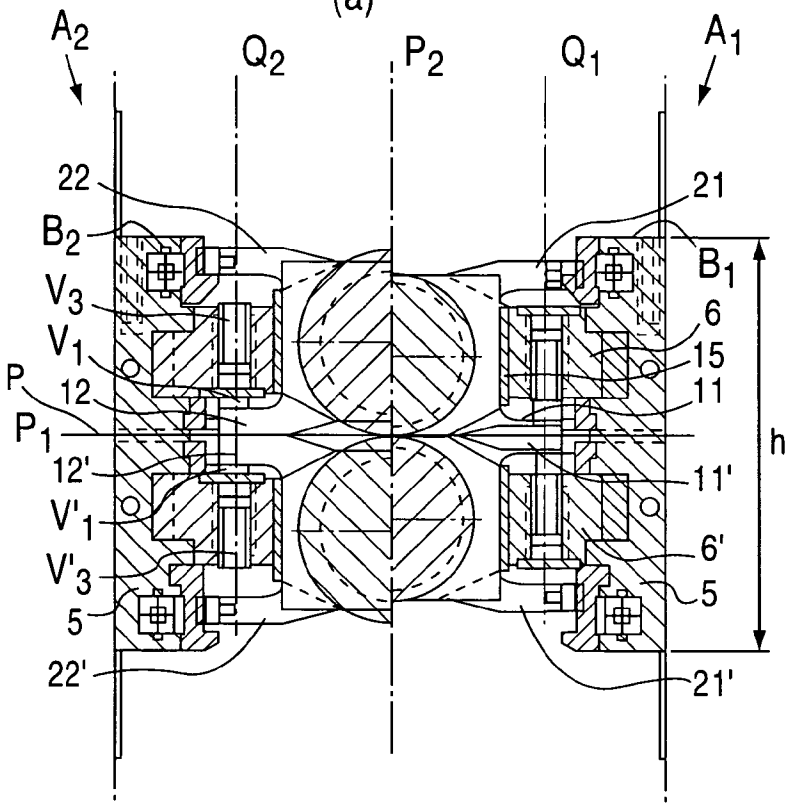
FIG. 2 shows, on an enlarged scale, the disposition of the rolls and of their cambering means, in rolling position, in a quarto configuration (a).
Figure 4:
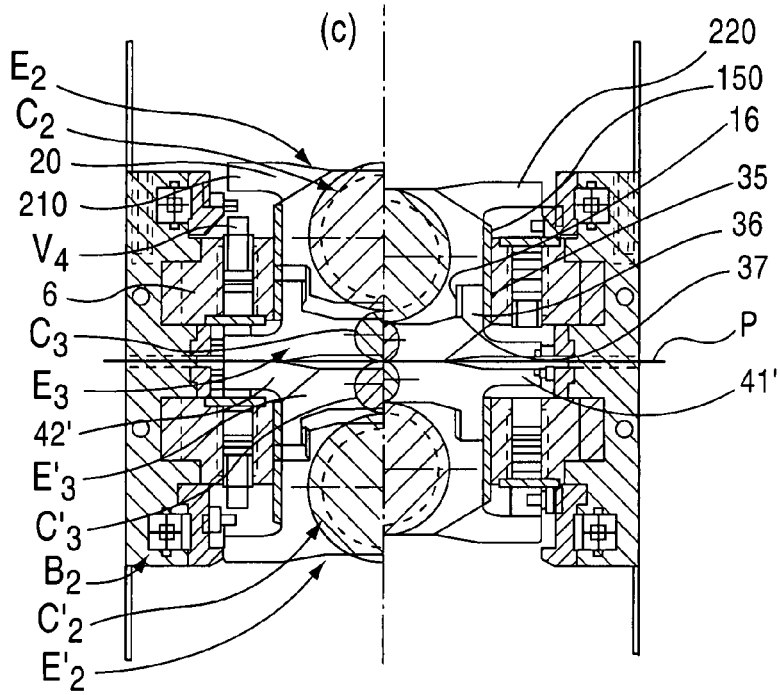
FIG. 4 shows the disposition of the rolls in a Z.High configuration (c).

FIGS. 2, 3 and 4 are respectively, cross-sectional views of the central portion of the stand, between the back-up rolls, for each configuration (a), (b), (c).

In the rolling position represented on these figures, the rolls abut against one another along a common generatrix, both working rolls C1, C'1 being spaced apart, simply, by a gap corresponding to the thickness to give to the product to be rolled.

Generally, the space requirements in height of the assembly of the rolls depend on the configuration of the rolling mill. The height H of the window A3 should hence be sufficient to enable the installation of all the chocks in the most cumbersome configuration, i.e. the sexto configuration represented in FIG. 3, and for the maximum diameter of the rolls of each type.

Usually, the height of the hydraulic blocks B1, B2 which carry the portions F, F' for guiding the working chocks and the sets V, V' of cambering cylinders, depends on the number of rolls placed between the back-up rolls and on their diameters. However, since these hydraulic blocks B1, B2 are attached to the stanchions A1, A2, on both sides of the window, their height is limited by the space existing between the chocks S1, S'1 of the back-up rolls S, S' and should hence be reduced in the quarto configuration for which only two working rolls C1, C'1 are set between the back-up rolls S, S'.

Until now, consequently, a rolling stand was provided for a redefined configuration.

The invention enables, conversely, to give to the same rolling mill one of the three configurations (a), (b), (c) represented in FIG. 1 while keeping the same stand A and the same hydraulic blocks B1, B2. Moreover, thanks to the dispositions which will be described below, the invention enables to give the hydraulic blocks B1, B2, a minimum height (h), valid for all the configurations and which, in practice, may be of the same order as the sum of the diameters of the working rolls C1, C'1 in the quarto configuration, as shown in FIG. 2.

This reduction in height of the hydraulic blocks B1, B2 results, in particular, from the fact that each of said hydraulic blocks includes only two protruding portions F, F' which carry cambering cylinders V, V' acting in the positive direction and in the negative direction, these cylinders being, moreover centered in two vertical planes Q1, Q2 parallel to the clamping plane and spaced apart symmetrically on both sides thereof.

To do so, particular chocks adapted to the three configurations are used. They are of the type represented, in perspective, in FIGS. 4, 5 and 6. The assembly of said chocks between the hydraulic blocks is represented in FIGS. 7 to 12.

As indicated above, the diameters of the rolls may vary on a certain wearing range. The different members of the rolling mill, in particular the stand, the hydraulic blocks and the cambering cylinders, are, normally, suited to a certain type of roll. Moreover, as the rolls should be disassembled for maintenance and rectification after use and because the downtime of the rolling mill should be reduced as far as possible, said mill is normally fitted with several sets of rolls enabling rapid replacement of the rolls in operation with new rectified rolls.

The working rolls placed on both sides of the rolling plane should be replaced more often and, far as they are warn in the same way, both working rolls are disassembled and re-assembled simultaneously.

On the other hand, the back-up rolls and the intermediate rolls, may be replaced individually, in sexto configuration.

Thus, a rolling stand is associated with means for rapid replacement of the rolls which will be used for changing the configuration according to the invention.

Moreover, each roll is disassembled with its chocks and the new rolls should hence be equipped in advance, in a workshop, with both their chocks and their bearings.

According to the invention, to enable the selection of a configuration adapted to the nature of the product to be processed, the rolling stand represented in FIG. 1 will be equipped, on the one hand with a certain type of back-up rolls S, S' which remains the same in all the configurations and, on the other hand, with at least two and, preferably, three types of working rolls having different diameters, respectively rolls with great diameter C1, rolls with average diameter C2 and rolls with small diameter C3.

In the quarto configuration, represented in FIGS. 1(*a*) and 2, two rolls with great diameter C1, C'1 are used as working rolls. In the sexto configuration represented in FIGS. 1(*b*) and 3, two rolls with average diameter C2, C'2 are used as working rolls and, two rolls with great diameter C1, C'1 are used as intermediate rolls between each working roll C2, C'2 and the corresponding back-up roll S, S'.

In the Z.High configuration represented in FIGS. 1(*c*) and 4, rolls with small diameter C3, C'3 are used as working rolls and two rolls with average diameter C2, C'2 are used as intermediate rolls between each working roll C3, C'3 and the corresponding back-up roll S, S'.

It should be noted that, in the quarto configuration, one could also use, two rolls with average diameter C2, C'2 as working rolls.

For simplification purposes of the drawings, the lateral resting means associated, as known, with the working rolls C3, C'3 in the Z.High configuration, have not been represented in FIGS. 1, 4, 8, 13, 14.

According to one of the feature of the invention, the change in configuration may be conducted very rapidly, for instance by using a replacement system of known type wherein the rolls are disassembled and re-assembled by a displacement parallel to the axis thereof, each chock being fitted with rollers running on rails arranged on the stand, at a disassembly level for which the rolls are spaced apart from one another so that their surface is not damaged.

Thus, to switch from the quarto configuration of FIG. 1(*a*) to the sexto configuration of FIG. 1(*b*), the back-up rolls S, S' which may, besides, remain in the stand, are first of all, moved respectively upward and downward, substantially to the levels which should be occupied in the sexto configuration. The working rolls C1, C'1 are then placed at their disassembly level. It is advantageous to use a replacement device containing two cells, respectively an empty cell wherein both working rolls C1, C'1 previously in operation are transferred, and a cell wherein, on the one hand, two rolls with average diameter C2, C'2 have been placed at the level of the working rolls and, on the other hand, two rolls with great diameter C1, C'1, of the same type as those which have just been removed at the level of the intermediate rolls. All these rolls have been equipped in advance with their chocks. After placing the new rolls in the alignment of the rails, they are inserted in the stand, in operation position and the back-up rolls may be brought closer to one another. In a known fashion, for easier disassembly and replacement, the rolls and their chocks may be placed in cartridges including, either two working rolls C1, C'1, or a set of two working rolls and of two intermediate rolls, for the sexto configuration.

When the change of configuration is justified by a change in the production scale, one may have several sets of rolls in stock and insert, into the stand, rolls having, for instance, a surface quality better suited to the new product to be rolled.

On the other hand, as indicated above, for the same type of rolls, diameters may vary over a certain range.

For a particularly fast of configuration, it is preferable that the back-up rolls are left in place in the stand. However, in certain cases, it may be advantageous to select, in the set of the back-up rolls available, rolls with relatively great diameter for the quarto configuration and rolls of the same type but of slightly smaller diameters in the sexto configuration in order to reduce the global space requirements of the rolls.

According to another particularly advantageous feature of the invention, which will be described in more detail below, both rolls of the same type, respectively with great diameter, with average diameter or with small diameter, may be equipped with the same chocks which are arranged so that, they may equip, either an upper roll, or a lower roll by a simple inversion. Thus the benefit is a modular disposition enabling to keep in stock, simply, three types of chocks, respectively for great diameters, for average diameters and for small diameters and to fit upon request the new rolls while orienting the chocks according to the disposition they may have, either above or below the rolling plane.

FIGS. 6, 7 and 8 show, respectively, the three types of chocks usable for a roll with great diameter (FIG. 6) with average diameter (FIG. 7) or with small diameter (FIG. 8).

In this preferred embodiment, represented in the drawings, each chock is formed of three abutting portions, respectively a central portion and two end portions.

Thus, FIG. 6 shows a chock E1 for a roll with great diameter, containing a central portion 1 on the sides of which two end portions, respectively 2*a*, 2*b*, are fixed. FIG. 6 shows a chock for a lower roll but an upper chock would be composed in the same way, by a rotation of 180° before assembly on an upper roll.

As it is known, each roll is fitted at each end with a journal which rotates in a centering bearing housed in a cell forming the chock whereon the resting member of the cambering cylinders and the lateral sliding faces are arranged. According to the invention, the bearing (not represented) is housed in the central portion 1 of the chock and each end portion 2*a*, 2*b* is formed of a flange fitted with one circular orifice 25 to let through the journal. The central portion 1 of the chock is usually fitted, with resting members 11, 12 for the cambering cylinders. In the example represented, these resting members form protruding ears relative to the sides 15 of the chock whereon the sliding faces thereof are arranged, which are parallel to the clamping plane P2 (FIG. 2).

However, the disposition of the resting members is particular. Indeed, on one side of the chock, for instance the right-hand side on FIG. 6, the resting member 12 includes a central recess 14 between two spaced apart resting portions 12*a*, 12*b*. Conversely, on the other side of the clamping plane, the resting member 11 comprises a single resting portion between two recesses 13*a*, 13*b*. Moreover, both resting members 11, 12 are offset vertically with respect to the axis x'x of the journal spindled up to the chock so that, in the working position represented in FIG. 2, these resting members are placed substantially in the vicinity of the rolling plane P1.

Similarly, both flanges forming the end portions 2*a*, 2*b* fixed to both sides of the central portion 1 of the chock carry, each two resting members, respectively 21*a*, 22*a*, on the front flange 2*a* and 21*b*, 22*b* on the rear flange 2*b*, which are offset vertically with respect to the axis x'x of the chock. Moreover, each flange 2*a*, 2*b* is fitted with a protruding section forming a horizontally extending neck 23 and capable of engaging in a combined groove of same section, provided on the side of the central portion 1 of the chock and forming a mortise. Thus, it is possible, by turning the flanges 2*a*, 2*b* over with respect to the central portion 1, to place the resting members, either on two planes spaced apart in height, as represented in FIG. 6, or in the same plane, these resting planes being offset vertically on one side or on the other of the axis x'x of the chock.

Thanks to these dispositions, a chock of the type represented on FIG. 6, may be arranged in diverse ways, by inversion, either the chock assembly, or the end portions only.

First of all, by turning over by 180°, around the axis x'x, of the chock assembly, said chock may be mounted, either on an upper working roll C1, or a lower working roll C'1, in a quarto configuration.

Moreover, by turning over the end portions 2*a*, 2*b* only with respect to the central portion 1, the same chock may be adapted to the sexto configuration while keeping practically the same spacing of the resting members relative to the rolling plane P1.

Figure 9:
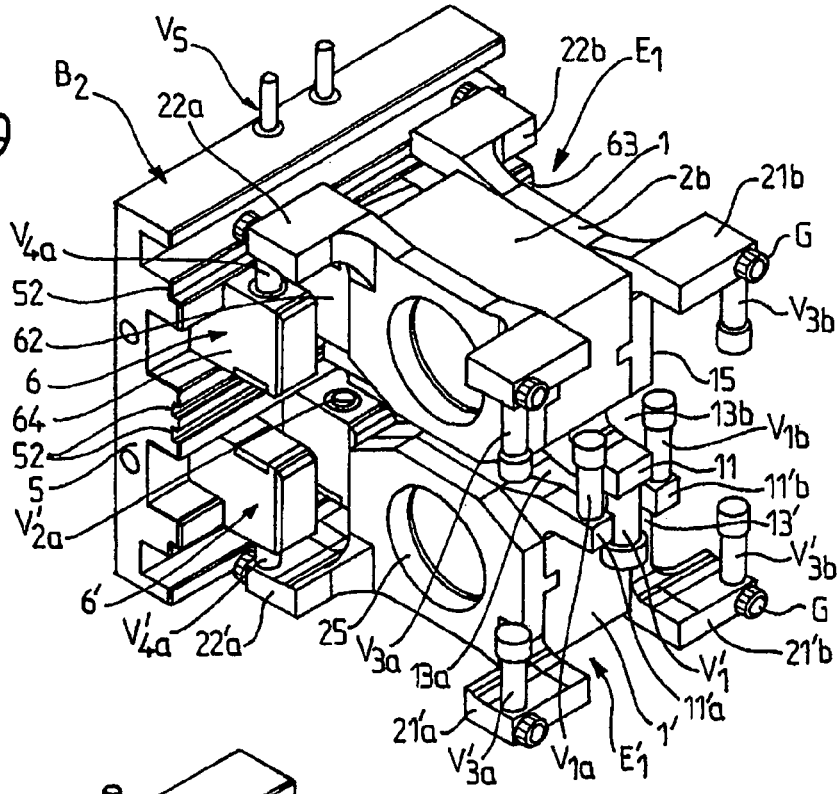
FIG. 9 and FIG. 10 are partial perspective views, respectively, of the positive cambering and of the negative cambering of the working rolls in a quarto configuration.
Figure 10:
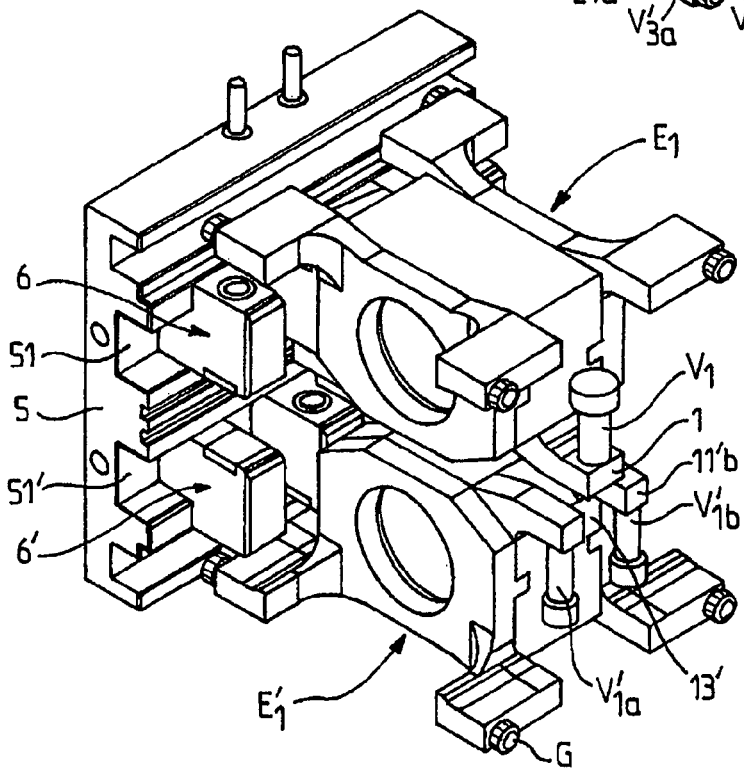

FIGS. 9 and 10 show the disposition and the use of two chocks of the type of FIG. 6, respectively for the positive cambering and for the negative cambering of the working rolls, in the quarto configuration.

As represented on FIG. 2, the cambering, respectively positive and negative cambering, of the rolls is conducted by two sets of cylinders respectively upper V and lower V' cylinders, which are centered on two planes Q1, Q2 parallel to the clamping plane P2. As usually, these cambering cylinders rest on the protruding parts F, F' of both hydraulic blocks B1, B2 fixed on both sides of the window A3.

However, for the implementation of the invention, it is particularly advantageous to use the particular disposition of the chocks and of the hydraulic blocks represented on the drawings, wherein, on the one hand, each hydraulic block includes only two protruding portions spaced apart on both sides of the rolling plane, and, on the other hand, the resting members of the chocks may be placed, by a simple inversion thereof, either between both protruding portions, substantially in the vicinity of the rolling plane, or above and below thereof. Such a disposition enables, indeed, to reduce the space requirements in height of the hydraulic blocks, while defining only three resting levels of the chocks which remain the same in all the configurations, respectively a central resting level of the working chocks corresponding substantially to the rolling plane and two resting levels, respectively upper and lower, of the intermediate rolls placed respectively above and below protruding parts of the hydraulic blocks.

FIGS. 9 and 10 are partial perspective views showing, in a quarto configuration, the disposition of the working chocks and the cambering cylinders, respectively in the positive direction in FIG. 9 and in the negative direction in FIG. 10.

In this quarto configuration, rolls with great diameter associated to the chocks of the type represented on FIG. 6 are used and it can be seen that particularly advantageously, the same chocks may, by a simple inversion, act as upper chock E1, or as lower chock E'1, each chock being symmetrical with respect to a middle plane perpendicular to the axis x'x of the journal.

Each hydraulic block B1, B2 comprises a massive part 5 fixed to the internal face of the corresponding stanchion A1, A2 of the column and carrying two parts 6, 6' placed symmetrically relative to the rolling plane P1 and which protrude towards the inside of the window to an end 61, 61' carrying a vertical face for guiding the corresponding chock E1, E'1.

On each protruding part 6, 6', the cylinders are arranged in two groups, respectively a central group of cylinders acting towards the rolling plane P1 and a group of lateral cylinders placed on both sides of the central group and acting on the side opposite to the rolling plane P1. Both these groups of cylinders are placed, respectively, in a central portion 62 and two lateral portions 63, 64 of the protruding parts 6 and are centered on a same plane Q1, Q2 parallel to the clamping plane P2, on both sides thereof.

For the reasons stated below, in the preferred embodiment represented in Figures, the central portion 62 is interconnected with the massive part 5 fixed to the stanchion corresponding of the stand whereas both lateral portions 63, 64 may slide axially in grooves 51, 51' arranged on this part 5.

In the preferred embodiment represented in the figures, the central portion 62 of each protruding part 6, 6' carries three cylinders all acting towards the rolling plane but controlled separately, some for the positive cambering and others for the negative cambering. Conversely, the cylinders placed in the lateral portions 63, 64 act of the side opposite to the rolling plane, solely for the positive cambering.

FIG. 9 is a partial view, in perspective, representing only the positive cambering cylinders. As indicated above, the upper chock E1 placed above the rolling plane comprises a central portion 1 fitted with two resting members 11, 12, protruding on both sides 15 of the chock, respectively on the right (11) and on the left (12) in the figure, these resting members being placed at a level corresponding, substantially, to that of the rolling plane. On the other hand, as shown in FIG. 6, both resting members extending on both sides of the central portion 1 of the chock have reverted-nick profiles, one containing a central recess sandwiched by two resting portions whereas the other includes a central resting portion sandwiched by two recesses.

It should be noted that the disposition of FIG. 6 correspond to a lower chock E'1, the upper chock E1 being turned over as a single block by 180°.

Thus, in the assembly of FIG. 9, the central portion 1 of the upper chock E1 placed above the rolling plane includes, on the right, a central resting portion 11 sandwiched by two recesses 13*a*, 13*b* whereas the resting ear 12 placed of the left-hand side and not visible on the figure, includes a central recess sandwiched by two resting portions.

Conversely, the lower chock E'1 includes, on the right-hand side, two resting portions 11'*a*, 11'*b* sandwiching a central recess 13', the disposition being reversed on the left-hand side. Thus, the facing resting members have nicked profiles which overlap one another.

Consequently, the positive cambering of the upper chock E1 may be controlled by a central cylinder V'1 mounted in the central portion of the corresponding protruding part 6' and running through the rolling plane P1 to exert a positive cambering load on the central resting portion 11 of the upper chock 1.

Conversely, the positive cambering of the lower chock E'1 is conducted, on the right-hand side of the Figure, by two cylinders V1*a*, V1*b* mounted in the central portion of the upper protruding part 6 and acting, in the positive direction, on the resting portions 11'*a*, 11'*b* of the lower chock 11'*a* between which the positive cambering cylinder V'1 of the upper chock E1 runs.

In this assembly, a positive cambering load may also be exerted by lateral cylinders, respectively V3*a*, V3*b* on the right-hand side and V4*a*, V4*b* on the left-hand side, set up in the lateral portions 63, 64 of the protruding part 6 and acting in the positive direction, i.e. on the side opposite to the rolling plane, on the resting members of both end portions 2*a*, 2*b* of the chock, respectively 21*a*, 21*b* on the right-hand side and 22*a*, 22*b* on the left-hand side.

Obviously, the disposition is reversed for the lower chock E'1.

Thus, the positive cambering loads may be applied by the set of the cylinders and at two levels on each working chock in the quarto configuration, which enables to have an upper cambering load.

For the negative cambering, the cylinders acting towards the rolling plane and mounted in the central portion 62 of each protruding part 6, 6' as indicated on FIG. 10 are used.

Generally, the central group of cylinders cooperating with the central portions 1, 1' of both chocks E1, E'1, is composed of at least two pairs of opposite cylinders acting, respectively in the positive direction and in the negative direction on both faces of the corresponding resting member of the chock. As seen already, in the preferred embodiment represented on FIGS. 9 and 10, the central portion 1 of the upper chock E1 is fitted with a central resting member 11 whereon, in the negative direction, a central cylinder V1 rests, mounted in the central portion 62 of the upper protruding part 6 of the hydraulic block and, consequently, opposite to the positive cambering cylinder V'1 of the same chock, which is placed on the other side of the rolling plane and runs therethrough.

Conversely, the negative cambering of the lower chock E'1 is conducted, on the right-hand side of the Figure, by two cylinders V'1*a* and V'1*b* mounted in the protruding part lower 6', which exert cambering loads directed towards the rolling plane on the resting portions 11'*a*, 11'*b* running on both sides of the cylinder V'1 of positive cambering of the upper chock E1, and are opposed to the positive cambering cylinders V1*a*, V1*b* of the same lower chock E'1, set up in the upper protruding part 6.

Obviously, the disposition is reversed on the hydraulic block B2 placed on the left of the clamping plane and whereof the upper protruding part 6 carries, in its central portion two negative cambering cylinders of the upper chock E1 and a central positive cambering cylinder of the lower chock E'1, the disposition being reversed on the central portion 62' of the protruding part lower 6' of the hydraulic block B2.

To switch from the quarto configuration to the sexto configuration represented in FIG. 3 and, partially, in perspective in FIGS. 11 and 12, according to the invention, intermediate rolls of the same type as the working rolls C1, C'1 of the quarto configuration are used, which are hence spaced apart from one another in order to implement working rolls with average diameter C2, C'2.

The ends 61 of both protruding parts 6, 6' are then used for guiding the working chocks E2, E'2. Since, according to one of the features of the invention, the height of the hydraulic blocks B1, B2 should be limited to that which is necessary for the quarto configuration, the guiding of the intermediate chocks E1, E'1, in the sexto configuration, is provided by two supporting parts B3 bearing laterally on the stanchions A1, A2 which limit the sides of the window A3 and whereon vertical guiding faces (f) are arranged parallel to the clamping plane P2.

In this configuration, the hydraulic blocks B1, B2 still define three resting levels of the cambering cylinders, respectively a central level H1 corresponding substantially to that of the rolling plane P1 and two levels, respectively upper H2 and lower H'2 placed above and below the protruding parts 6, 6'. Both sets of cylinders V, V' placed in these protruding parts 6, 6' remain the same but their functions are different. As in the quarto configuration described above, the central cylinders V1, V2, V'1, V'2 which act at the central level H1, in the direction of the rolling plane P1 will be used for positive and negative cambering of the working rolls C2, C'2 whereas the lateral cylinders V3, V4, V'3, V'4 which act at the levels H2 and H'2, towards the side opposite to the rolling plane, are used for the positive cambering of the intermediate rolls C1, C'1.

However, the lateral faces 15 of the intermediate chocks E1, E'1 should slide between the guiding faces (f) arranged on the supporting parts B3, B'3. To do so, the end portions 2*a*, 2*b* of each chock E1, E'1 are inversed by 180° with respect to the central portion 1. This inversion may be conducted easily since as indicated, the end portions 2*a*, 2*b* of the chock are fitted with horizontal necks 23 which engage in corresponding grooves of the central portion 1.

With respect to the disposition represented in FIG. 6, after rotation of the end portions 2*a*, 2*b*, the resting members 21, 22 change sides and move to a position substantially in the alignment of the resting members 11, 12 of the central portion 1. After lifting the roll C1, the resting members 21, 22 of the end portions come back substantially to the same level H2 as in the quarto configuration. As shown in FIG. 11, the cylinders V3*a*, V3*b* placed on the right-hand side, exert hence positive cambering loads on the resting members 22*a*, 22*b* of both end portions 2*a*, 2*b* of the upper intermediate chock E1. Similarly, both resting members 21, placed on the left after rotation, co-operate with the lateral cylinders V4 for the positive cambering of the intermediate roll C1.

The disposition is the same, in reverse direction, for the chock E'1 of the intermediate lower roll C'1.

As shown in FIG. 7, the chocks of the rolls with average diameter which, in the sexto configuration, form the working rolls C2, C'2, are analogous to the chocks E1, E'1 of the rolls with great diameter and include hence a central portion 10 whereon two end portions 20*a*, 20*b* are abutting. Obviously, the bearings, not represented in Figures, are adapted to the diameter of the journals of the rolls C2, C'2 with average diameter, but the spacing between the lateral faces 150 of the working chocks E2, E'2 is the same as the spacing between the lateral faces 15 of the chocks E1 with great diameter. The sliding faces 150 of the chocks E2, E'2 may hence slide along the same guiding faces 61 arranged at the ends of the protruding parts 6, 6' of both hydraulic blocks B1, B2.

However, to enable Z.High configuration assembly as will be described below, the sliding faces 150 of a chock E2 with average diameter, extend only over a portion of the height of the chock, the latter being fitted, on the remaining portion, with two lateral sliding faces 16 whereof the spacing is reduced.

On the other hand, as for the chocks of the intermediate rolls E1, E'1, the end portions 20*a*, 20*b* are fixed to the central portion 10 so that their resting members 210, 220 are placed at the same level as the resting members 110, 120 of the central portion 10.

FIGS. 11 and 12 show, in perspective, the disposition of the cambering cylinders, on the right-hand side of the clamping plane, respectively in the positive direction in FIG. 11 and in the negative direction in FIG. 12.

As can be seen in FIGS. 3 and 11, the upper working chock E2 is turned over as a single piece with respect to FIG. 7, so that its resting members 210, 220 are placed substantially in the vicinity of the rolling plane P2, the sliding faces 150 extending directed upward to slide between the ends 61 of the protruding parts uppers 6. As in the quarto configuration, the positive cambering of the working roll C2 is conducted, on the right-hand side of Figure, by the central cylinder V'1 which is set up of the other side of the rolling plane and goes through the latter to be applied to the resting member 110 of the central portion 10.

Conversely, the positive cambering of the lower chock E'2 is conducted, on the right, by both cylinders V1*a*, V1*b* which run through the recesses arranged on both sides of the resting central member 110 to be applied to the resting portions 110'*a*, 110'*b* of the lower chock E'2, extending on both sides of the central cylinder V'1. Obviously, the disposition is symmetrical for the left side.

In this sexto configuration, the resting members 210*a*, 210*b* of the end portions 20*a*, 20*b* of the working chock E2 are hence not used for the cambering but carry, simply, rollers G which, conventionally, run on of the rails R placed for the disassembly, these rollers G being, thus, sufficiently spaced apart for ensuring under good conditions the sliding motion of the chock.

According to the invention, the rolls with average diameter C2, C'2 fitted with their chocks E2, E'2 may be used as intermediate rolls in a Z.High-type sexto configuration, as represented in the view (c) of FIG. 1, as well as in FIGS. 4, 13 and 14.

In such a case, working rolls C3, C'3 with small diameter are used which are associated with the chocks E3, E'3 of the type represented on FIG. 8.

Such a chock still comprises, preferably, three abutting portions, respectively a central portion 3 and two end portions 4*a*, 4*b*. The central portion 3 carries the centering bearings of the roll and may have relatively reduced height, the journals of a working roll having a small diameter in the case of a Z.High assembly.

As previously, this central portion 3 is fitted, on both sides of the axis x'x of the bearing, with two sliding faces 35, whereof the spacing corresponds to that of the facing ends 61 of the protruding parts 6 of both hydraulic blocks B1, B2 and two resting members 31, 32 which protrude relative to the plane of the sliding faces 35.

FIG. 8 represents the chock in its position E3 corresponding to a working roll upper and it includes hence a central resting portion 31 which extends only over a portion of the length of the chock and is sandwiched by two recesses 33*a*, 33*b*. Conversely, on the left-hand side, the resting member 32 comprises two portions spaced apart on both sides of a central recess 34.

Thus, as shown in FIGS. 13 and 14, the chock E3 of the working roll upper C3 is fitted, on the right-hand side of Figure, with a resting part 31 which extends substantially in the vicinity of the rolling plane P2 and runs between the rods of both cylinders V1, V'1 housed respectively in the protruding parts 6, 6', the lower cylinder V'1 acting in the positive direction (FIG. 13) and the upper cylinder V1 in the negative direction (FIG. 14). Conversely, the chock E'3 of the lower roll C'3 is fitted, on the right-hand side of Figure, with two resting portions 31'*a*, 31'*b* whereon two pairs of opposite cylinders act, respectively, the upper cylinders V1*a*, V1*b* in the positive direction (FIG. 13) and the lower cylinders V'1*a*, V'1*b* in the negative direction (FIG. 14).

As previously, the disposition of the cylinders and of the resting members on the left of the figure is deduced from that on the right by a central symmetry.

As shown in FIG. 4, in this Z.High configuration, the rolls with average diameter C2, C'2 are used as intermediate rolls, which are hence spaced apart from one another to place the rolls with small diameter C3, C'3 and whereof the chocks E2, E'2 are turned over as a single piece with respect to the sexto disposition of FIG. 3. So, the resting members 220, 210 of the end portions 20*a*, 20*b* of the upper chock E2 are placed above the upper level of the protruding parts 6 and co-operate, consequently, with the lateral cylinders V3, V4 of the hydraulic blocks B1, B2, respectively on the right and on the left of the figure, the disposition being symmetrical for the lower intermediate chock E'2.

In this Z.High disposition as in the sexto disposition described previously, the invention enables to exert positive cambering loads on the intermediate rolls.

These sliding faces 35 which extend above or below resting members 31, 32, are arranged on two vertical jamb posts 36 of the central portion 3 of the chock E3 whereof the internal sides 37 form the guiding faces for the intermediate chock E2, as will be seen below.

As indicated, the sliding faces 150 of a chock with average diameter E2 extend only over a portion of the height thereof and are extended by narrower sliding faces 16 which, in the Z.High assembly slide along the internal faces 37 of the jamb posts 36 of the central portion 3 of the chock E3 of the roll with small diameter C3.

Thus, as shown in FIG. 4, the guiding faces 61 arranged at the ends of the protruding parts 6, 6' serve, over a portion of their height, for guiding the working chocks E3, E'3 and, on the remaining section, for guiding the intermediate chocks E2, E'2 which are also guided, by their sliding faces 16, on the jamb posts 36 of the working chocks E3, E'3.

The dispositions which have just been described also enable axial offset of the intermediate rolls, in the sexto or Z.High configurations.

Figure 15:
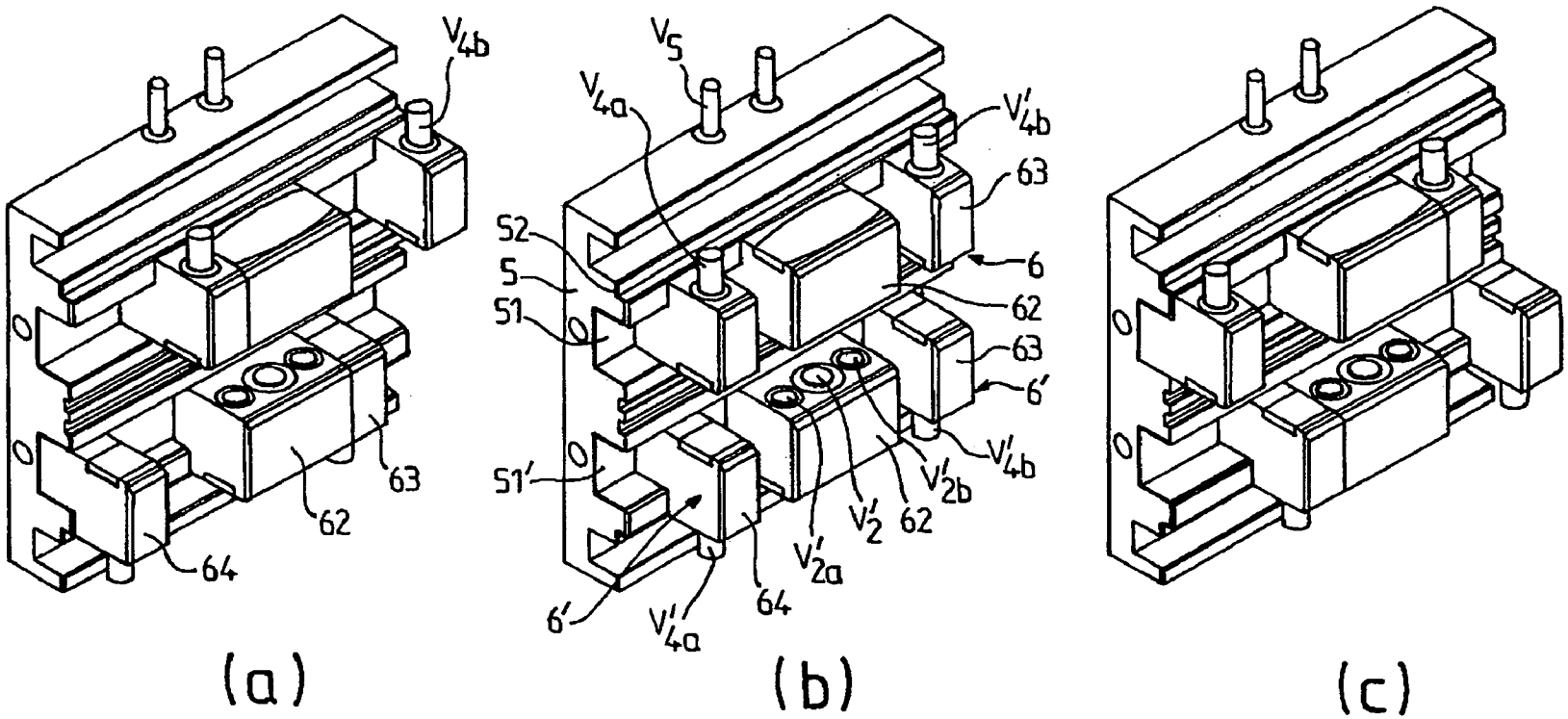
FIG. 15 shows, in perspective, a hydraulic block with axial offset in one direction or in the other, of a portion of the cambering cylinders.

Indeed, as shown in FIG. 15, both lateral portions 63, 64 of a protruding part 6 are mounted slidingly axially in a groove 51 of the massive section 5 of the hydraulic block B, the central portion 62 remaining fixed. So, the central cylinders V2, V'2 which act towards the rolling plane B2 remain fixed axially but the lateral cylinders, respectively upper V3, V4 and lower V'34, V'4 mounted, on both sides of the clamping plane, on the mobile portions 63, 64 of the protruding parts 6, 6' may move axially with the chock of the corresponding roll.

Such displacement may take place in both directions, as shown in the three perspective views (a) (b) (c) of FIG. 15.

FIG. 11, for instance, corresponds to the view (c) of FIG. 15 with an offset towards the rear for the upper intermediate roll C1 and towards the front for the lower intermediate roll C'1. FIG. 12, conversely, corresponds to the view (a) of FIG. 15 with an offset towards the front of the upper intermediate roll C1 and towards the rear of the lower intermediate roll C'1. On the view (b) of FIG. 15, which corresponds to the quarto configuration represented in FIGS. 9 and 10, there is no axial offset of the rolls, the mobile parts 63, 64 being spaced apart symmetrically with respect to the central part 62, as represented in the view (b) of FIG. 15.

Thus, by in the sexto or Z.High configurations, the intermediate rolls C1, C'1 or C2, C'2 may be moved axially with their chocks and the cambering cylinders positive V3, V4, V'3, V'4. Conversely, in the three configurations, the chocks of the working rolls remain centered in the middle plane of the hydraulic blocks B1, B2, as well as the central cylinders V1, V2, V'1, V'2.

As usually, in each configuration, the rolls may be disassembled and replaced by parallel displacement to their axes, while running on removable or retractable rails.

These rails may be formed, for instance, of profiles 7 set up slidingly on grooves 52 parallel to the axes of the rolls and arranged on both sides of the clamping plane, on the massive portions 5 of both hydraulic blocks B1, B2.

As shown in FIG. 15, these grooves may be arranged on four levels, on both sides of each protruding part 6, 6', to enable the assembly of four pairs of rails, respectively upper 71, 72 and lower 71', 72'.

As already indicated, the resting members of the end portions 2, 20, 30, of each type of chock E1, E2, E3 carry rollers G spaced apart axially.

Figure 5:
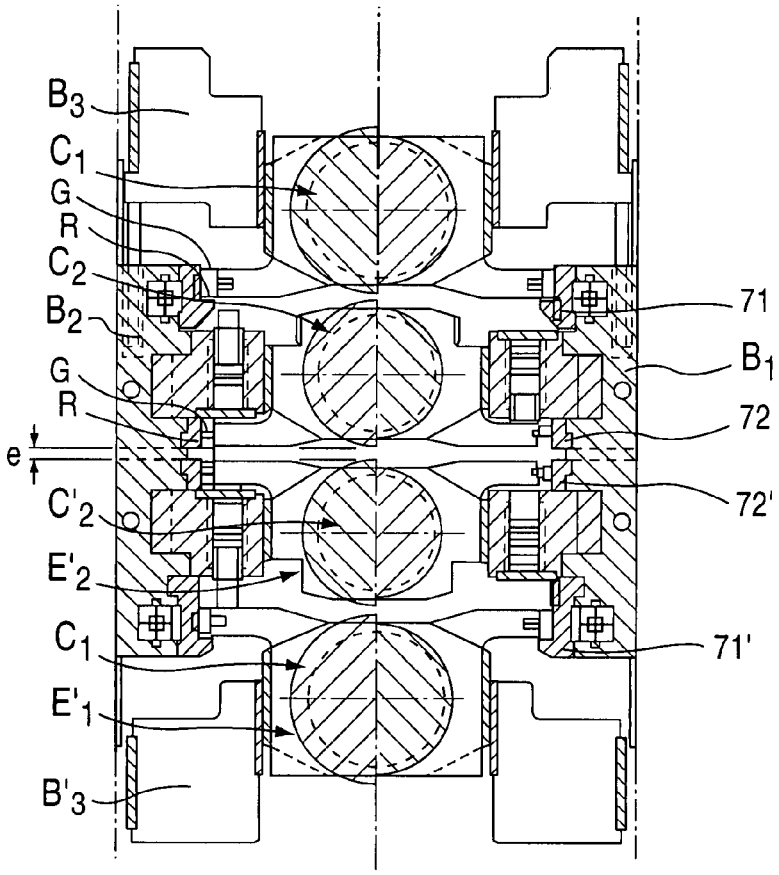
FIG. 5 shows, on an enlarged scale, the disposition of the rolls and of their cambering means, in disassembly position in the sexto configuration (b).

By way of example, FIG. 5 shows the rolls in disassembly position, for the sexto configuration. Both upper rolls, respectively working roll C2 and intermediate roll C1 may be lifted by their positive cambering cylinders, slightly above the levels of the rails to enable the placement thereof inside the stand, by axial sliding on the grooves 52. The rolls may then be lowered so that their rollers G rest on the rails 71, 72.

As shown in FIG. 3, in rolling position, the rollers mounted at the ends of the resting members of the chocks E'2, E'1 of both rolls lower, respectively working roll C'2 and intermediate roll C'1, are placed, anyway, above the level of the lower rails 72' 71' which may hence be placed, by axial sliding, for disassembly of the rolls. If the lower back-up roll S' is lowered thanks to a wedging means not represented, both rolls C'1, C'2 go down therewith and their rollers will finally rest on the respective rails 72', 71' to enable the disassembly and the reassembly of the rolls by axial displacement.

The profiles 7 comprising the rails cold also be fitted with retractable supporting sections to enable adjustment of the levels of the chocks, during the rolling process.

The dispositions which have just been described enable hence easy and rapid change in the configuration of a rolling mill to switch, according to the nature of the product to be rolled, from a quarto configuration to a sexto or Z.High configuration and conversely, by using only three types of rolls having, respectively, a great, an average and a small diameter and while keeping all the essential members of the rolling mill, i.e. the stand A, the clamping means D, and the hydraulic blocks B1, B2 carrying the cylinders for adjusting the levels of the rolls. As indicated, since the same hydraulic blocks are used in the three configurations, the height of the latter may be limited, the guiding being ensured by simple added jamb posts B3 which may be attached removably to the chocks of the back-up rolls S, S'.

The height H of the window A3 should, however, correspond to the total height of the chocks in the sexto configuration and it is the reason why it is advantageous, in the quarto and Z.High configurations represented respectively in the views (a) and (c) of FIG. 1, to have, at the ends of each window A3, two massive parts M, M' forming interposed shims, on the one hand between the clamping means D and the chocks S1 of the upper back-up roll and on the other hand between the lower section of each window A3 and the wedging means not represented whereon the lower back-up chocks S'1 rest. Thus, the travel of the clamping cylinders D need not to be increased.

But the invention is not limited to the details of the embodiment which has just been described by way of preferred example and covers conversely the variations or the equivalent means fulfilling the same functions and remaining within the extent of the protection claimed.

For instance, in the embodiment which has just been described, the positive and negative cambering of the rolls is ensured by pairs of opposite single-effect cylinders acting, respectively, towards the rolling plane and on the side opposite thereto. Indeed, such cylinders will simply abut against the resting members of the chocks and release the latter when they are retracted. It would be, however, possible to use double-effect cylinders having a rod fixed removably on the resting member of the chock and enabling, thus, to ensure the negative and positive cambering of the corresponding roll.

On the other hand, in the dispositions described previously, the resting members of the chocks, sometimes called <<ears>> protrude relative to the sliding faces arranged on each side of the chock. The invention could, however, be adapted to other known dispositions. For instance, the cambering loads could be applied, on both sides of the chock, to an intermediate part engaging a groove provided in the corresponding sliding face, this groove being offset with respect to the axis of the chock so as to provide two positions thereof, by a simple inversion.

Besides, the invention does not apply necessarily to a new plant, but exhibits conversely great advantages for the modernization of an existing plant.

In the case of a new plant, as described previously, three types of rolls will be selected having respectively a great, an average and a small diameter and enabling to process a very large range of products, the dimensions of the stand being determined relative to the sexto configuration which show the maximum space requirements.

But the invention also enables, within the framework of a modernization, to widen the range of products which may be processed in an existing rolling mill while keeping the same stand, the latter being simply adapted, for instance for placing hydraulic cambering blocks therein. For instance, an existing quarto stand having too small a window height for a conventional sexto configuration, could be modernized, thanks to the invention, while enabling to switch from a quarto configuration to a Z.High configuration or conversely, the range of rollable products being thus widened.

Besides, symmetrical stands relative to the rolling plane should be used preferably but, in certain cases, the dispositions which have just been described, would enable to realize dissymmetrical assemblies.

Indeed, since the same hydraulic blocks may be kept in all the configurations, it would be possible, for instance, to realize a quarto assembly with a working roll of sufficient diameter on one side of the rolling plane and a Z.High assembly with a working roll of small diameter, on the other side of the rolling plane.

The invention gives hence numerous possibilities enabling to respond very flexibly to a change in the features of the products to be rolled.

On the other hand, the modular construction which has been described exhibits the advantage of using only three types of chocks for all the configurations, since each chock is fitted, on both sides of the clamping plane, with resting members having reverted profiles and may be used on one side of the rolling plane or on the other.

It would be possible, however, to realize chocks having the same resting members on both sides of the clamping plane, but with reverted nick profiles above and below the rolling plane. For instance, an upper chock might have, on both sides, a single resting portion placed between two recesses, the lower chock having, conversely, resting members containing, on both resting portions sandwiching a single recess. Such a disposition would still enable to realize hydraulic blocks of reduced height having a C-shaped profile with two protruding parts for supporting cambering cylinders acting on resting members placed substantially in the vicinity of the rolling plane while running therethrough in the positive cambering direction.

The reference signs inserted after the technical features mentioned in the claims, solely aim at facilitating the understanding thereof and do not limit their extent in any way.

The invention claimed is:

1. A method for changing a configuration of a rolling mill from first rolls to second rolls, in a supporting stand, the mill including a pair of back-up rolls mounted in back-up roll chocks, the back-up roll chocks being fitted with lateral sliding faces to slide along mated guiding faces on an inner surface of the supporting stand and housing the first rolls between the back-up rolls, the first rolls including upper and lower first rolls disposed on opposite sides of a rolling plane, each end of each first roll being carried by a first roll chock mounted slidingly along guiding faces of hydraulic blocks attached to the inner surface of the supporting stand, the method comprising:

moving the pair of back-up rolls away from each other;

placing the first rolls disposed in the respective first roll chock on rails, arranged in the supporting stand at a disassembly level, and removing the first rolls;

aligning the second rolls, disposed in respective second roll chocks, on the rails to replace the first rolls;

slidingly inserting the second rolls into the supporting stand between the back-up rolls; and moving the pair of back-up rolls toward each other, applying a clamping load between the back-up roll chocks; and applying vertical cambering loads to the second rolls, wherein the first rolls and the second rolls are selected from one of:

a pair of working rolls, each working roll being disposed on opposite sides of the rolling plane; and a pair of intermediate rolls and a pair of working rolls therebetween, each working roll and corresponding intermediate roll being disposed on opposite sides of the rolling plane, the method further comprising providing rolls having one of a small, medium or large diameter, respectively, disposed in corresponding roll chocks, the rolls remaining fitted in the corresponding roll chocks in each configuration, wherein changing the configurations further comprises:

the first rolls being configured in a quarto configuration having a pair of large diameter rolls as working rolls, the first rolls being configured from a quarto configuration having the pair of large diameter rolls as working rolls to a sexto configuration with the second rolls having the pair of large diameter rolls as intermediate rolls and a pair of medium diameter rolls as working rolls, and the first rolls being configured from a sexto configuration having the pair of large diameter rolls as intermediate rolls and the pair of medium diameter rolls as working rolls to a Z-high configuration with the second rolls having the pair of medium diameter rolls as intermediate rolls and a pair of small diameter rolls as working rolls.

2. The method according to claim 1, wherein the step of applying a vertical cambering load to the second rolls comprises applying a force in a positive direction by spacing-apart the working roll chocks with respect to the rolling plane and in a negative direction by bringing the working roll chocks together with respect to the rolling plane, on both sides of the rolling plane and on both sides of the clamping plane, through at least two pairs of cambering cylinders acting on the pair of large diameter rolls serving as working rolls in the quarto configuration, on the pair of medium diameter rolls serving as working rolls in the sexto configuration and on the pair of small diameter rolls serving as working rolls in the Z-high configuration.

3. The method according to claim 2, wherein on both sides of the rolling plane and on both sides of the clamping plane, the at least two pairs of cambering cylinders apply a force to the large diameter rolls serving as working rolls in the quarto configuration, to the large diameter rolls serving as intermediate rolls in the sexto configuration and to the medium diameter rolls serving as intermediate rolls in the Z-High configuration.

4. The method according to claim 1, wherein when changing the configuration, the back-up rolls remain in place in the supporting stand.

5. The method according to claim 1, wherein forming the Z-high configuration further comprises replacing the pair of back-up rolls, wherein the pair of back-up rolls in the Z-high configuration have a smaller diameter than the pair of back-up rolls in the quarto configuration.

6. A rolling mill having one of three configurations, the rolling mill comprising:

a supporting stand having two spaced apart columns, each column including two stanchions on opposite sides of a clamping plane, the stanchions delineating a window therein and having opposite inner surfaces;

a pair of back-up rolls disposed in back-up roll chocks, each back-up roll chock being disposed on an opposite side of a substantially horizontal rolling plane perpendicular to the clamping plane, the back-up roll chocks being fitted with lateral sliding faces which slide along mated guiding faces on the inner surface of the stanchion so that the back-up rolls are mounted slidingly in the window of each stanchion, parallel to the clamping plane;

rolls having one of a small, medium or large diameter, respectively, disposed in corresponding roll chocks, the rolls remaining fitted in the corresponding roll chocks in each configuration;

clamping means for applying a clamping load to the back-up roll chocks, the clamping means being disposed in an upper section of each window in the supporting stand; and cambering means for applying positive cambering loads to the roll chocks in a positive direction away from the rolling plane and applying negative cambering loads to the roll chocks in a negative direction toward the rolling plane, the cambering means being disposed on both sides of the clamping plane, wherein the rolling mill has a configuration selected from one of:

a quarto configuration wherein a pair of hydraulic blocks are disposed on both sides of the clamping plane and between the pair of back-up rolls, each hydraulic block being mounted to the inner surface of the stanchion and having thereon a pair of protruding parts, the pair of protruding parts being located respectively, on both sides of the clamping plane and on the same side of the rolling plane; and wherein the rolls include a pair of working rolls carried at opposite ends by working roll chocks and arranged between the pair of back-up rolls, the working roll chocks comprising upper working roll chocks and lower working roll chocks, the upper working roll chocks being disposed on a first side of a rolling plane and the lower working roll chocks being disposed on a second side of the rolling plane, the upper and lower working roll chocks delineating a space for passing a product along the rolling plane, the upper and lower working roll chocks having sliding faces and being mounted slidingly along guiding faces of the pair of protruding parts on end portions of the hydraulic blocks;

a sexto configuration wherein a pair of supporting parts bears laterally on the inner surfaces of the stanchions in the window of the supporting stand, wherein the rolls include a pair of intermediate rolls carried at opposite ends by intermediate roll chocks and arranged between the pair of back-up rolls, the intermediate roll chocks comprising upper intermediate roll chocks and lower intermediate roll chocks, the upper intermediate roll chocks being disposed on a first side of the rolling plane and the lower intermediate roll chocks being disposed on a second side of the rolling plane, the upper and lower intermediate roll chocks being mounted slidingly along guiding faces on end portions of the pair of supporting parts;

wherein a pair of hydraulic blocks are disposed on both sides of the clamping plane between the pair of intermediate rolls, each hydraulic block being mounted to an inner surface of the stanchion and having thereon a pair of protruding parts, the pair of protruding parts being located respectively, on both sides of the clamping plane and on the same side of the rolling plane; and wherein the rolls include a pair of working rolls carried at opposite ends by working roll chocks and arranged between the pair of intermediate rolls, the working roll chocks comprising upper working roll chocks and a lower working roll chocks, the upper working roll chocks being disposed on a first side of the rolling plane and the lower working roll chocks being disposed on a second side of the rolling plane, the upper and lower working roll chocks delineating a space for passing a product along the rolling plane, the upper and lower working roll chocks having sliding faces and being mounted slidingly along guiding faces on end portions of the pair of protruding parts of the hydraulic blocks, and wherein the pair of working rolls have a medium diameter and the pair of intermediate rolls have a large diameter; and a Z-high configuration wherein a pair of hydraulic blocks are disposed on both sides of the clamping plane between the pair of back-up rolls, each hydraulic block being mounted to an inner surface of the stanchions, and having thereon a pair of protruding parts, the pair of protruding parts being located respectively, on both sides of the clamping plane and on the same side of the rolling plane;

wherein the rolls include a pair of intermediate rolls carried at opposite ends by intermediate roll chocks and arranged between the pair of back-up rolls, the intermediate roll chocks comprising upper intermediate roll chocks and lower intermediate roll chocks, the upper intermediate roll chocks being disposed on a first side of the rolling plane and the lower intermediate roll chocks being disposed on a second side of the rolling plane, the upper and lower intermediate roll chocks having sliding faces and being mounted slidingly along guiding faces on end portions of the pair of protruding parts of the hydraulic blocks;

wherein the rolls include a pair of working rolls carried at opposite ends by working roll chocks and arranged between the pair of intermediate rolls, the working roll chocks comprising upper working roll chocks and lower working roll chocks, the upper working roll chocks being disposed on a first side of the rolling plane and the lower working roll chocks being disposed on a second side of the rolling plane, the upper and lower working roll chocks delineating a space for passing a product along the rolling plane, the upper and lower working roll chocks having sliding faces and being mounted slidingly along guiding faces on end portions of the pair of protruding parts of the hydraulic blocks, and wherein the pair of working rolls have a small diameter and the pair of intermediate rolls have either a medium diameter or a large diameter.

7. The rolling mill according to claim 6, wherein the cambering means comprise a set of upper and lower cambering cylinders that are housed on both sides of the rolling plane, in the pair of protruding parts, respectively upper and lower, arranged on the hydraulic block.

8. The rolling mill according to claim 7, wherein, in the quarto configuration, each protruding part of the hydraulic block extends toward the inside of the window, and has a guiding face which is parallel to the clamping plane and cooperates with the sliding faces of the working roll chocks.

9. The rolling mill according to claim 7, wherein, in the sexto configuration, the sliding faces of the intermediate roll chocks, co-operate with guiding faces arranged on the pair of supporting parts, and wherein the pair of supporting parts are removably mounted inside of the window of the supporting stand, respectively, above and below the pair of protruding parts of the hydraulic block.

10. The rolling mill according to claim 9, wherein the pair of supporting parts comprise jamb posts removably fixed to the back-up roll chocks.

11. The rolling mill according to claim 7, wherein, in the Z-high configuration, the pair of protruding parts, extend toward the inside of the window and have a guiding face parallel to the clamping plane, each guiding face cooperating with both sliding faces of the working roll chocks and the intermediate roll chocks.

12. The rolling mill according to claim 7, wherein the upper and lower working roll chocks are fitted, on both sides of the clamping plane, with at least one resting member protruding with respect to the corresponding sliding faces of the upper and lower working roll chocks, in order to co-operate with the set of upper and lower cambering cylinders, wherein, in each configuration, the at least one resting member of the upper and lower working roll chocks are placed substantially in the vicinity of the rolling plane, between the pair of protruding parts, and wherein the at least one resting member of the upper working roll chocks disposed on the first side of the rolling plane is fitted with at least one recess for receiving at least one cambering cylinder of the set of upper and lower cambering cylinders disposed on said first side and running through the rolling plane for resting, in the positive direction away from the rolling plane, on a corresponding resting member of the lower working chock disposed on the second side of the rolling plane, and wherein the lower working roll chocks are fitted with at least one recess for receiving the at least one cambering cylinder of the set of upper and lower cambering cylinders disposed on said second side and running through the rolling plane for resting, in the positive direction, on the resting member of the upper working roll chocks.

13. The rolling mill according to claim 12, wherein in the quarto or sexto configuration, the resting members of the working roll chocks are offset vertically with respect to their rotational axes, so that, after vertical displacement of the working roll chocks, and inversing the working roll chocks by 180° around their axes, the resting members are situated substantially at the same level with respect to the rolling plane.

14. The rolling mill according to claim 12, wherein the set of upper and lower cambering cylinders includes a group of central cambering cylinders acting in a direction towards the rolling plane and a group of lateral cambering cylinders acting in a direction away from the rolling plane, while resting on said protruding part, and wherein the hydraulic blocks provide three resting levels for the resting members of the upper and lower working roll chocks, a central resting level corresponding to the rolling plane for the resting members of the upper and lower working roll chocks, an upper resting level above the upper protruding part for the resting members of the upper intermediate roll chocks and a lower resting level below the lower protruding part for the lower intermediate roll chocks.

15. The rolling mill according to claim 7, wherein the upper and lower protruding parts have at least one mobile portion carrying, respectively the set of upper and lower cambering cylinders, the upper and lower protruding parts being slidingly mounted, parallel to the rolling plane and to the clamping plane, on the corresponding hydraulic block and wherein the rolling mill further comprises means for controlling the simultaneous axial sliding motion, with the set of upper and lower cambering cylinders and a corresponding roll, of the at least one mobile portion disposed on both sides of the clamping plane and on a same side of the rolling plane.

16. The rolling mill according to claim 15, further comprising means for controlling the sliding motion of the upper and lower protruding parts placed respectively on both sides of the clamping plane and on the same side of the rolling plane, with an intermediate roll.

17. The rolling mill according to claims 15 or 16, wherein on both sides of the clamping plane, the upper and lower protruding parts include a fixed central portion with respect to the supporting stand and two mobile portions placed on both sides of the central portion and slidingly mounted axially on the hydraulic block, wherein each set of upper and lower cambering cylinders includes at least one central cambering cylinder bearing on the fixed central portion of the protruding part and acting in a negative direction towards the rolling plane, and at least two lateral cambering cylinders bearing respectively on the two mobile portions of the protruding part and acting in a positive direction away from of the side opposite to the rolling plane, and wherein each working roll chock comprises a central portion fitted, on each side, with a resting member for the at least one central cambering cylinder and two end portions abutting both sides of the central portion, and wherein the end portions are fitted, on both sides of the clamping plane, with a an end portion resting member for the at least two lateral cambering cylinders set up on a corresponding mobile portion of the protruding part.

18. The rolling mill according to claim 17, wherein the resting members arranged on each end portion of the working roll chocks are offset vertically with respect to the axis of the roll in order to determine, by rotation of the at least one of the two end portion around said axis, two levels of the resting members with respect to the axis, respectively a level offset towards the rolling plane for a chock of a working roll in quarto configuration and a level offset of the side opposite to the rolling plane for a chock of an intermediate roll in sexto configuration.

19. The rolling mill according to claim 7, wherein, in the sexto configuration, each protruding part of the hydraulic block extends toward the inside of the window, and has a guiding face which is parallel to the clamping plane and cooperates with the sliding faces of the working roll chocks.

20. The rolling mill according to claim 6, wherein the cambering means comprise a set of upper and lower cambering cylinders including a group of central cambering cylinders and a group of lateral cambering cylinders, centered, substantially in two planes parallel to the clamping plane and spaced apart symmetrically on both sides thereof.

21. The rolling mill according to claim 20, wherein on both sides of the clamping plane and on both sides of the rolling plane, each protruding part of the hydraulic block carries at least one of the group of central cambering cylinders acting in the negative direction toward the rolling plane and two of the group of lateral cambering cylinders acting in the positive direction away from the the rolling plane.

22. The rolling mill according to claim 21, wherein, in the quarto configuration, the two of the group of lateral cambering cylinders act, in the positive direction, on the upper and lower working roll chocks.

23. The rolling mill according to claim 6, wherein each of the upper and lower working roll chocks is formed of a central portion abutting two end portions, wherein the central portion supports a centering bearing of the corresponding roll and is fitted on both sides of the clamping plane with at least one resting member that protrudes beyond the sliding face of the upper and lower working roll chocks and is perpendicular to the axis of the central portion, and wherein the at least one resting member removably enables the central portion to be connected to the two end portions for transmitting the cambering loads and, for turning over the two end portions with respect to the central portion, after disconnection of the central portion and the two end portions.

24. The rolling mill according to claim 23, wherein the central portion of each of the upper and lower working roll chocks is fitted, on both sides of the clamping plane with the at least one resting member for engaging at least one first central cambering cylinder disposed on a first side of the rolling plane, said at least one resting member providing at least one recess for receiving at least one second central cambering cylinder disposed on the second side of the rolling plane.

25. The rolling mill according to claim 23, wherein each hydraulic block includes a group of central cambering cylinders acting on the at least one resting member in the positive direction and the negative direction, and wherein each cylinder of the group of central cambering cylinders acts on the at least one resting member of the upper working roll chocks disposed on a first side of the rolling plane, bears on the protruding part of the hydraulic block placed on the second side of the rolling plane and passes through a recess provided in a corresponding resting member of the lower working roll chocks disposed on the second side of said rolling plane.

26. The rolling mill according to claim 25, wherein the at least one resting member of the central portion includes, on a first side of the clamping plane a single resting member cooperating with the central group of cambering cylinders, the single resting member being sandwiched by two recesses on one of the sliding faces of the working roll chocks, wherein on the second side of the clamping plane the at least one resting member of the central portion comprises two resting members spaced apart on both sides of a single recess and cooperating with a pair of the central cambering cylinders, and wherein the arrangement of the two resting members and of the central cambering cylinders is reversed for the lower working roll chocks.

27. The rolling mill according to claim 26, wherein the two end portions of the working roll chocks include end portion resting members arranged thereon and the lateral cambering cylinders act in the positive direction on the end portion resting members.

28. The rolling mill according claim 23, wherein the two end portions of the working roll chocks include end portion resting members arranged thereon, wherein lateral cambering cylinders bearing on each protruding part of the hydraulic block act in the positive direction on the end portion resting members.

29. The rolling mill according to claim 23, wherein the two end portions of the working roll chocks include end portion resting members that are fitted with rollers running on rails parallel to the rolling plane and to the clamping plane for disassembly and reassembly of the working roll by a displacement parallel to the axis thereof.

30. The rolling mill according to claim 23, wherein, in the Z-high configuration, each working roll chock of the roll with the small diameter is formed of a central portion abutting two end portions, wherein the central portion supports a centering bearing of the working roll, and is fitted, on both sides of the clamping plane with the at least one resting member for resting at least two central cambering cylinders acting in the negative and positive directions, and wherein the two end portions are connected to the central portion and each are fitted, on both sides of the clamping plane, with an end portion resting member carrying at least one roller for running on rails parallel to the rolling plane and to the clamping plane, for disassembly of the working roll by a displacement parallel to the axis thereof.

31. The rolling mill according to claim 30, wherein the supporting stand is fitted with disassembly rails on three levels, respectively, a central level corresponding substantially to that of the rolling plane, the central level having two running rails for running the upper and lower working roll chocks, and upper and lower levels, having a running rail for the upper and lower intermediate roll chocks.

32. The rolling mill according to claim 6, wherein, in the quarto configuration, shims are interposed between each end of the window and the corresponding adjacent back-up roll chock to reduce the height of the windows.

33. The rolling mill according to claim 6, wherein the hydraulic blocks have a height not exceeding substantially the sum of the diameters of the large diameter rolls.

34. The rolling mill according to claim 6, wherein, in the Z-High configuration, shims are interposed between each end of the window and corresponding adjacent back-up roll chock to reduce the height of the windows.

* * * * *